US012259160B2

(12) United States Patent
Gale et al.

(10) Patent No.: US 12,259,160 B2
(45) Date of Patent: Mar. 25, 2025

(54) POWERED ROOM AIR PURIFIER WITH EASY-LOADING AIR FILTER

(71) Applicant: 3M INNOVATIVE PROPERTIES COMPANY, St. Paul, MN (US)

(72) Inventors: Brian D. Gale, Blaine, MN (US); Andrew R. Fox, Oakdale, MN (US); Alonso M. Hernandez, Minneapolis, MN (US); Nicolas W. Tremain, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 532 days.

(21) Appl. No.: 17/628,780

(22) PCT Filed: Aug. 5, 2020

(86) PCT No.: PCT/IB2020/057402
§ 371 (c)(1),
(2) Date: Jan. 20, 2022

(87) PCT Pub. No.: WO2021/024201
PCT Pub. Date: Feb. 11, 2021

(65) Prior Publication Data

US 2022/0381461 A1 Dec. 1, 2022

Related U.S. Application Data

(60) Provisional application No. 62/883,230, filed on Aug. 6, 2019.

(51) Int. Cl.
*F24F 8/80* (2021.01)
*F24F 13/28* (2006.01)

(52) U.S. Cl.
CPC ..... *F24F 8/80* (2021.01); *F24F 13/28* (2013.01)

(58) Field of Classification Search
CPC ..... B01D 46/0002; B01D 46/0005; B01D 46/0004; B01D 46/001; B01D 46/10;
(Continued)

(56) References Cited

U.S. PATENT DOCUMENTS 5,679,121 A * 10/1997 Kim ..... B01D 46/10 55/506
6,066,041 A * 5/2000 Hernandez ..... F24F 1/027 62/262
(Continued)

FOREIGN PATENT DOCUMENTS

CN 1888709 1/2007
CN 106338103 1/2017
(Continued)

OTHER PUBLICATIONS

Filtrete Elite Room Air Purifier User Manual, 2018, 14 pages.
(Continued)

*Primary Examiner* — Christopher P Jones
*Assistant Examiner* — Sonji Turner
(74) *Attorney, Agent, or Firm* — Kenneth B. Wood

(57) ABSTRACT

A powered room air purifier including a non-movable air filter holder. The room air purifier may include at least one guide ramp located at an upper end of the air filter holder. An air filter may be installed into the air filter holder by a combination of translational and rotational movement of the air filter.

22 Claims, 11 Drawing Sheets

(58) Field of Classification Search
CPC ..... B01D 46/16; B01D 2265/00; B01D 2265/022; B01D 2265/024; B01D 2265/025; B01D 2265/028; F24F 8/80; F24F 8/108; F24F 13/28
See application file for complete search history.

(56) References Cited

U.S. PATENT DOCUMENTS 6,293,983 B1 * 9/2001 More ..... B01D 39/1615 55/491
6,354,936 B1 * 3/2002 Noh ..... F24F 13/085 16/361
6,685,760 B2 2/2004 Huehn
7,537,647 B2 5/2009 Adair
7,833,309 B2 * 11/2010 Pippel ..... B01D 46/44 55/471
8,562,913 B2 * 10/2013 Searle ..... A61L 9/16 422/121
9,821,260 B2 * 11/2017 Stoner, Jr. ..... B01D 46/62
10,234,150 B2 * 3/2019 Noh ..... B01D 46/4227
10,434,448 B1 * 10/2019 Honnecke ..... F24F 13/28
2007/0000221 A1 1/2007 Park
2010/0000413 A1 1/2010 Turner
2011/0006216 A1 * 1/2011 Searle ..... F24F 8/167 250/455.11
2015/0273381 A1 * 10/2015 Stoner, Jr. ..... B01D 46/62 96/418
2016/0280045 A1 * 9/2016 Nefzer ..... B01D 46/0005
2019/0107302 A1 4/2019 Liu
2019/0226696 A1 * 7/2019 Kim ..... F24F 6/04

FOREIGN PATENT DOCUMENTS

EP 2364418 B1 * 10/2017 ..... F24F 1/0007
JP 2009172509 8/2009
WO WO 2010-053228 5/2010
WO WO-2010053228 A1 * 5/2010 ..... F24F 1/0007
WO WO 2017-101049 6/2017

OTHER PUBLICATIONS

Filtrete Ultra Slim Air Purifier User Manual, 2006, 28 pages.
International Search Report for PCT International Application No. PCT/IB2020/057402, mailed on Oct. 27, 2020, 4 pages.

* cited by examiner

POWERED ROOM AIR PURIFIER WITH EASY-LOADING AIR FILTER

BACKGROUND

Room air purifiers are often used to purify (e.g., to remove at least some fine particles from) ambient air e.g. in rooms of houses, condominiums, apartments, offices, and so on.

SUMMARY

In broad summary, herein is disclosed a powered room air purifier comprising a non-movable air filter holder. The room air purifier may include at least one guide ramp located at an upper end of the air filter holder. An air filter may be installed into the air filter holder by a combination of translational and rotational movement of the air filter. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

Like reference numbers in the various figures indicate like elements. Some elements may be present in identical or equivalent multiples; in such cases only one or more representative elements may be designated by a reference number but it will be understood that such reference numbers apply to all such elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated.

DETAILED DESCRIPTION

Figure 1:
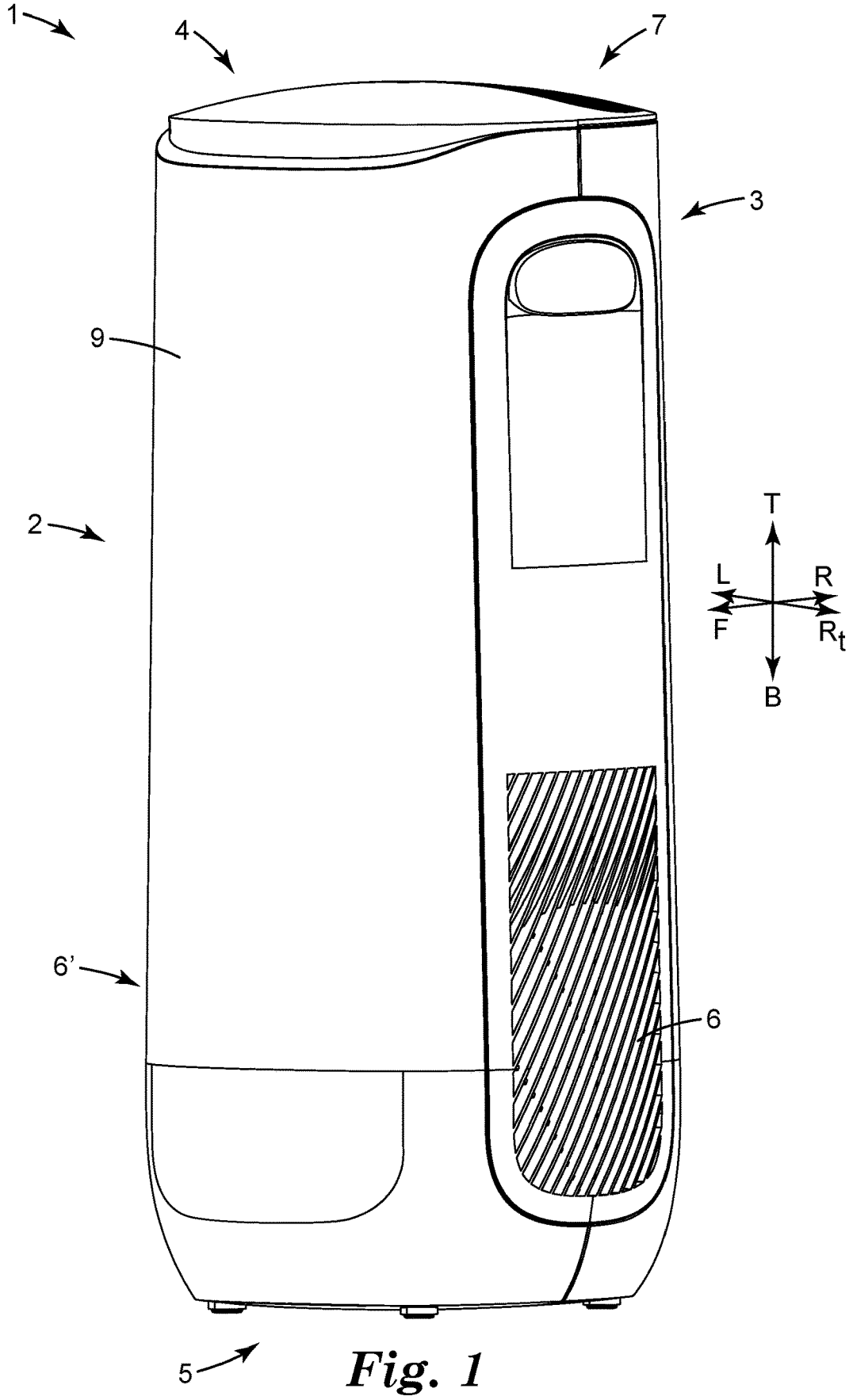
FIG. 1 is a front-side perspective view of an exemplary room air purifier as disclosed herein.

Shown in FIG. 1 in front-side perspective view is an exemplary powered room air purifier 1. Room air purifier 1 includes a housing 9 defining at least one air inlet 6, at least one air outlet 7, and an airflow path therebetween. Housing 9 may also establish a "front" side 2, a "rear" side 3, and top 4 and bottom 5 of the room air purifier. The vertical axis (with top and bottom directions indicated as T and B), transverse axis (with left and right directions indicated as L and $R_t$), and forward-rearward axis (F/R), of a room air purifier as positioned for ordinary operation, are identified in FIG. 1. However, it is noted that terms such as front and rear, forward, rearward, and the like, are used purely for convenience of description (in particular for ease of describing how an air filter can be installed into the room air purifier) and have no limiting meaning with regard to how a room air purifier is positioned or oriented within a room. Similarly, terms such as "top", "bottom", "upper end", "lower end", and so on, are used with respect to a room air purifier with its base resting on a floor or other horizontal surface in ordinary operation of the room air purifier. However, such terms are again used for convenience of description. In particular, it is possible that a room air purifier might be tilted at an angle, or even laid flat on a floor or table, in order to install an air filter thereinto. In such a case, the descriptions that follow will still be applicable but can merely be appropriately transposed in view of the orientation of the various items with respect to the Earth.

Often, housing 9 of powered room air purifier 1 may be constructed of one or more pieces, panels, and the like that are assembled together to form a hollow interior defining the airflow path therethrough as well as providing spaces for components such as motors, control units, and so on. The panels, parts etc. that collectively form housing 9 may be made of any suitable material, e.g. they may be molded polymeric parts, formed metal pieces, and so on. Air inlet 6 may be provided at any suitable location, for example on a major side of the room air purifier. In the particular design depicted in FIGS. 1 and 2, two air inlets 6 and 6' are provided, one on each transverse side of the room air purifier.

Room air purifier 1 includes at least one fan 12 (visible e.g. in FIG. 6) that motivates (e.g., pushes) air through the filter media of a disposable air filter installed within the room air purifier. Any number of air outlets, at any location, may be provided so that the filter air can exit the room air purifier. In the exemplary design of FIG. 1 an air outlet 7 is located at top end 4 of the room air purifier. By definition, room air purifier 1 is a powered room air purifier, meaning that fan 12 is driven by electric power, possibly from an internal power source (e.g. battery) but more conveniently delivered through a cord from an external power source. Typically, such a room air purifier can be moved e.g. from room to room (e.g. with one or more carrying handles provided, as are visible, unnumbered, in FIGS. 1 and 2).

Figure 2:
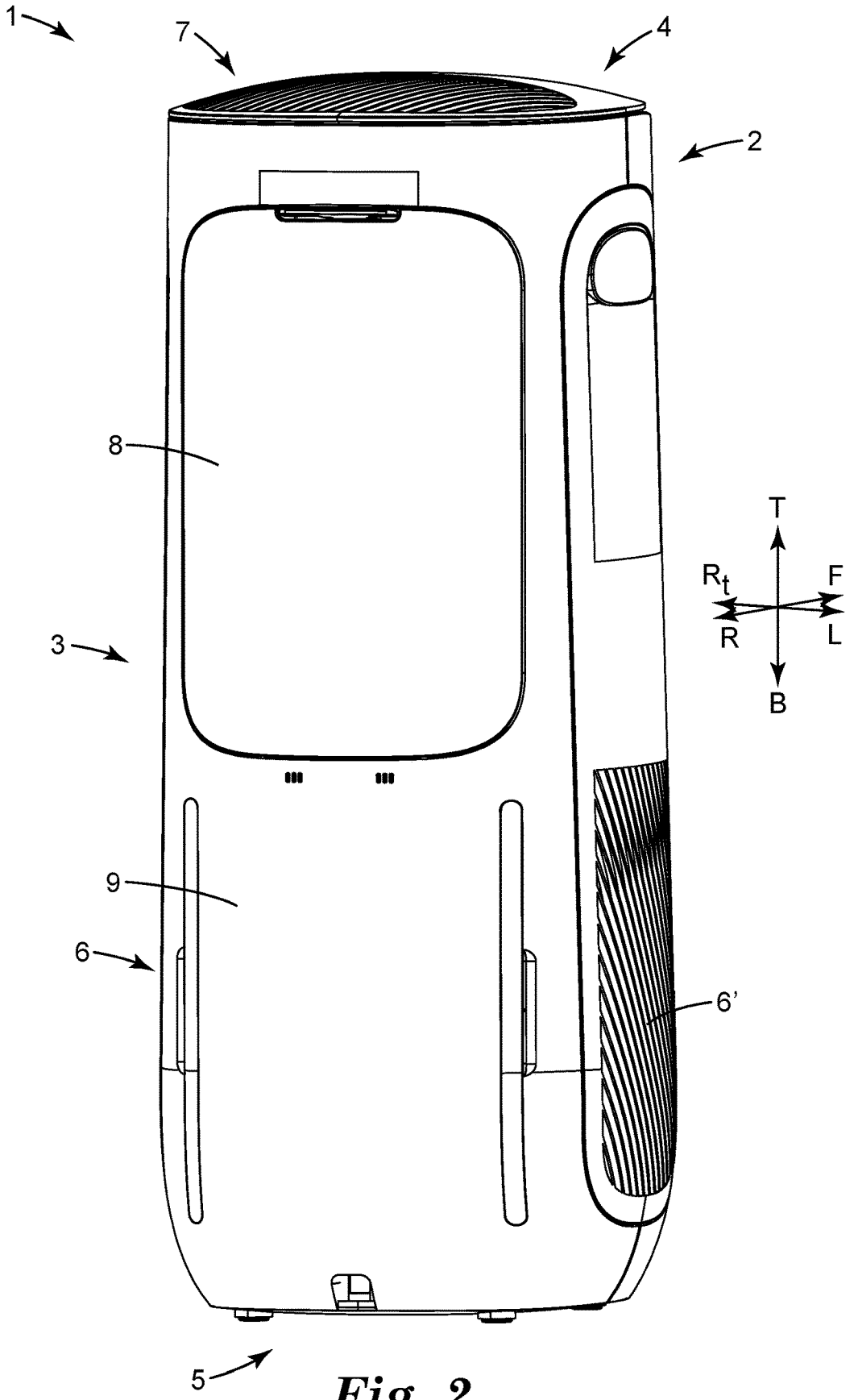
FIG. 2 is a rear-side perspective view of an exemplary room air purifier.
Figure 3:
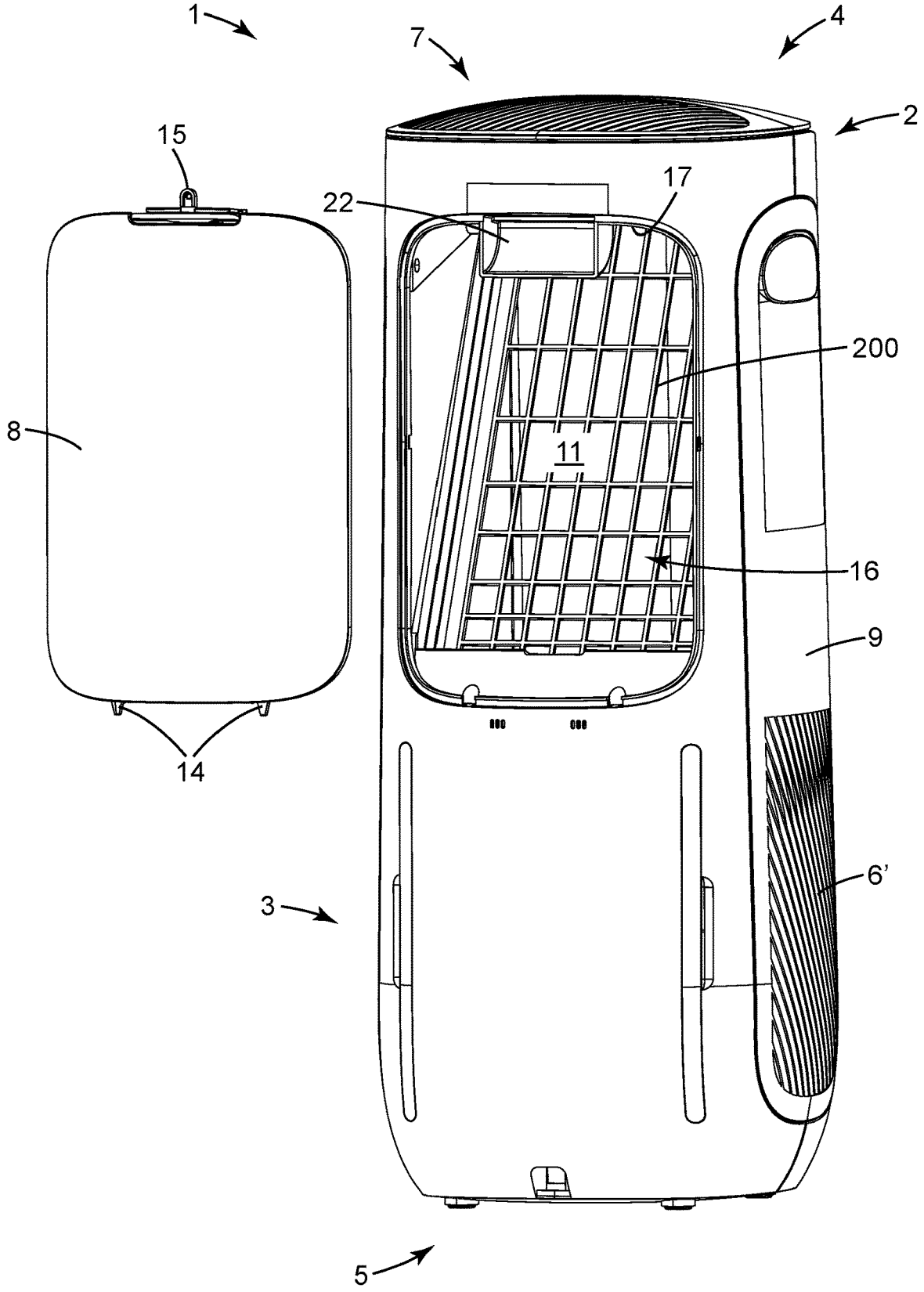
FIG. 3 is a rear-side perspective view of an exemplary room air purifier with a rear cover plate omitted to show an interior space comprising an exemplary air filter holder.

As shown in FIG. 2, a room air purifier 1 may comprise at least one cover plate 8 that is openable (e.g. as shown in FIG. 3) to allow access to an interior space 11 of the room air purifier. For consistency of description, cover plate 8 is designated here as being on the "rear" side 3 of the room air purifier; however, this does not limit placement or orientation of the room air purifier in actual use. In some embodiments (e.g. as in the design of FIG. 3) the cover plate 8 may be completely removable from the room air purifier; in other embodiments the cover plate may remain connected (e.g. hingedly connected) to the room air purifier but will be openable to a sufficient extent to allow the necessary access to the interior space 11 of the room air purifier. In the particular exemplary design of FIG. 3, cover plate 8 comprises a latch 15 at the upper end of the cover plate and hinge studs 14 at the lower end of the cover plate. To remove the cover plate, the latch 15 can be released and the upper end of the cover plate rotated outward (as allowed by the hinge studs 14) until the upper end of the cover plate is sufficiently far outward from the housing of the room air purifier that the cover plate can be removed. In some embodiments a latch housing (visible in FIG. 3 but not numbered) can partially encase the latch e.g. to minimize any air leaks that might occur in or around the latch. Regardless of the particular design of the cover plate, the latching mechanism, and so on, the cover plate can be at least moved (e.g. removed) to expose an opening 16 that allows access to an interior space 11 of the room air purifier so that a disposable air filter can be inserted thereinto and placed in a filter holder 200, as discussed in detail later herein.

In some embodiments a room air purifier 1 may comprise at least one screen located upstream (in the airflow path) from the fan and motor of the room air purifier. Any such screen will function to remove gross debris, pet hair, and the like, from the airstream before such items can reach the fan or motor. In some convenient embodiments, first and second screens may be located downstream of first and second air inlets 6 and 6'. In various embodiments, any such screen may be removable and cleanable (e.g. by wet-washing or dry-vacuuming); or, such a screen may be disposable and replaceable.

Figure 4:
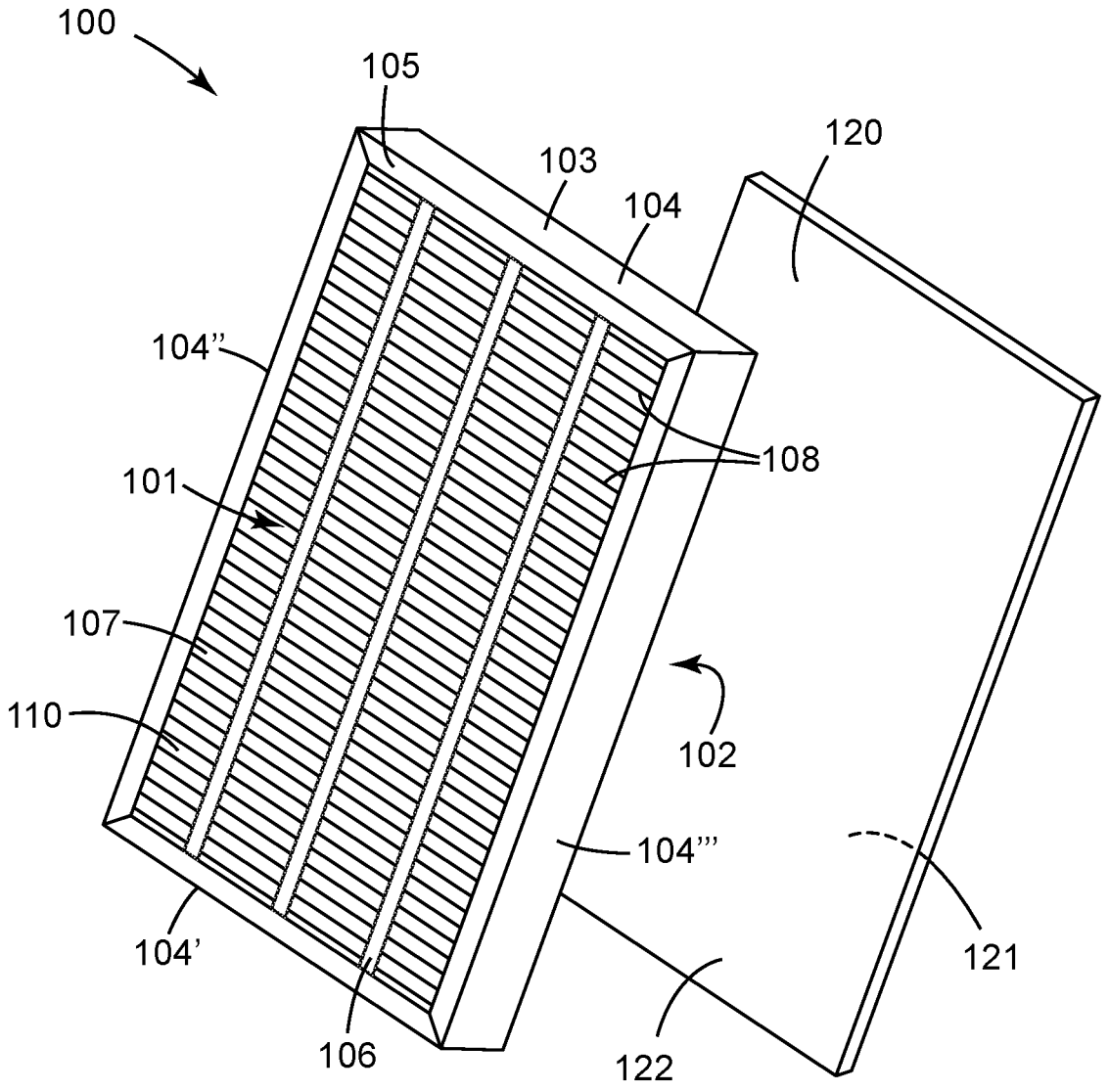
FIG. 4 is a perspective view of an exemplary disposable air filter that may be installed into an exemplary room air purifier as disclosed herein.

Room air purifier 1 is configured to accept a disposable air filter 100 thereinto (the term disposable generally denotes any air filter that is removable and replaceable by a fresh (or refurbished) filter, and thus encompasses filters that are recyclable). A disposable air filter 100 is shown in exemplary embodiment in FIG. 4. Such an air filter 100 will comprise at least a particulate filter 110 as shown in FIG. 4. In some embodiments, an air filter 100 will consist of only a particulate filter 110. In other embodiments, an air filter 100 will further comprise a prefilter 120, located upstream of the particulate filter 110 as shown in FIG. 4. Thus by definition, the term "air filter" as used herein specifically encompasses an air filter assembly (stack) comprising at least a particulate filter and a prefilter, as discussed below in detail.

A disposable air filter 100 (e.g. a particulate filter 110 and optionally a prefilter as noted elsewhere herein) will often exhibit a generally rectangular shape (which includes square shapes). A particulate filter 110 will comprise a downstream face 101 (from which filtered air is emitted) and an upstream face 102 that receives air motivated by the fan of the room air purifier. Filter 110 will typically comprise filter media 107 fitted with a support frame 103, as shown in exemplary embodiment in FIG. 4. In various embodiments, filter media 107 may be pleated to exhibit readily identifiable pleats 108; or, it may be unpleated. In either case (and irrespective of any pleats), in many embodiments air filter 100 (including particulate filter 110, and prefilter 120 if present) will comprise an overall shape that is planar and may thus exhibit a major plane as discussed later herein.

A support frame 103 will typically be permanently attached to (mounted on) the edges of the air filter media 107. Regardless of the particular configuration, a support frame 103 as disclosed herein will be a component of the air filter 100 (e.g. of particulate filter 110 of filter 100), not of a room air purifier 1. Frame 103 may often comprise peripheral sidewalls (e.g., top, bottom, left and right sidewalls 104, 104', 104", and 104'") that define terminal minor edges of the framed filter. In some embodiments a frame 103 may further comprise flanges 105 that extend from sidewalls 104 for a short distance toward the center of the filter media, on the downstream face 101 and/or the upstream face 102 of the filter 100. Upstream and downstream frame flanges may be generally parallel to each other (e.g., in the case of a U-shaped or "channel" frame); or, one set of flanges may be angled so as to form a so-called "pinch" frame.

In some cases a frame may comprise only sidewalls without any upstream or downstream flanges being present (such frames are often called edge-band frames). A frame 103 may be made of any suitable material(s), e.g. paperboard or cardboard that is folded to provide the various sidewalls (and flanges if present). In various embodiments, a frame 103 may be made of an injection molded plastic material; or, a nonwoven fabric, felt, or the like, of appropriate stiffness.

In some embodiments, a particulate air filter 110 may comprise at least one strip of resilient material that is located on an outer surface of a sidewall (e.g. sidewall 104, 104', 104", and/or 104'") of frame 103 of the air filter. In particular embodiments, similar strips will be located on, and extend along at least a portion of, all four of the sidewalls. Such strips may improve the snugness with which an air filter 100 can be installed in an air filter holder 200 of the room air purifier and may minimize any air leaks around the edges of the installed filter. Such strips of resilient material may have any suitable composition and form. A particularly convenient arrangement may to use an adhesive-backed foam strip that can be adhesively attached to a surface of a sidewall of the filter frame.

In some embodiments, at least the downstream face 101 of filter 110 may comprise support members (exemplary support members 106 are visible in FIG. 4) that extend at least partially across filter media 107 (in any direction). Such members may provide additional support, particularly on the downstream side of the filter media; and (particularly for pleated filter media), such members may assist in minimizing any deformation of the filter media in response to air pressure during operation of the room air purifier. In some embodiments such members may be strips of paperboard that may be connected to frame 103 at their terminal ends.

In some embodiments an air filter may comprise one or more pull tabs that can be grasped to aid in initiating removal of the air filter from the room air purifier, as discussed in detail later herein. Such a pull tab may be conveniently located proximate the lower end 112 (discussed later) of the particulate air filter 110, e.g. at a location near reference numeral 104' as shown in FIG. 4, and may protrude outwardly away from the major plane of the air filter for ready grasping. In some convenient embodiments such a pull tab may be attached to a support frame of the air filter.

The filter media 107 (whether pleated or not) of a particulate air filter 110 may be comprised of any material, in any configuration, that is capable of filtering moving air. Such media may include, but is not limited to, fibrous materials (e.g., nonwoven webs, fiberglass webs, and so on), honeycomb structures loaded with filter media and/or sorbent material, and so on. In particular embodiments, the filter media may include at least one layer that comprises at least some material that can be electrically charged to form an electret material. In some embodiments, the filter media of a particulate filter 110 may be a multilayer media that comprises at least one layer that includes an electret material for capturing particles, and at least one layer that includes a sorbent material (e.g. activated carbon) for removal of e.g. gases, vapors and/or odors. However, as discussed below, in some convenient embodiments a sorbent-containing layer may be provided as a prefilter rather than as a layer that is incorporated with (e.g. laminated to) the particulate-filter media. In some embodiments filter media 107 may comprise at least one layer capable of HEPA filtration. Often, such a layer will be a charged meltblown (blown microfiber) layer that is laminated to a stiffener or a pleatable backing.

As noted above, in some embodiments a disposable air filter 100 as disclosed herein may take the form of an air filter assembly comprising a particulate filter 110 and a prefilter 120 positioned upstream of the particulate filter. In some embodiments such a prefilter may be configured (e.g. with sorbent such as active carbon) to remove gases, odors, vapors, or the like. In some embodiments such a prefilter may be configured to remove coarse particles with the above-described particulate air filter 110 being configured to remove fine particles. In some embodiments multiple prefilters, e.g. for different purposes, may be used.

If a prefilter 120 is present, the prefilter 120 will comprise an upstream face 121 that may serve as the upstream face of air filter 100 (unless an additional prefilter is present), and a downstream face 122 that may face (e.g. abut against) the upstream face 102 of particulate filter 110 (or may face an additional prefilter). It will thus be appreciated that in embodiments in which an air filter 100 comprises one or more prefilters 120, references herein to an upstream face of the air filter 100 denote an upstream face of the farthest-upstream prefilter. Similarly, references herein to the thickness of air filter 100 will refer to the combined, total thickness of the particulate filter 110 and whatever other filters are present.

A prefilter 120 and a particulate filter 110 may be arranged together in any suitable manner. In some embodiments, a prefilter may be installed separately into a filter holder of a room air purifier, after which a particulate filter 110 is installed thereupon. However, in many embodiments, it may be convenient to bring the prefilter 120 and the particulate filter 110 together to form a filter assembly which is then installed in the filter holder e.g. as a unit. In some such embodiments, the prefilter 120 and the particulate filter 110 may be merely held together by manual pressure of a user during the installation process; after installation is complete, they will be held together (and held in place in the filter holder) by the arrangements disclosed later herein.

In some embodiments, a prefilter 120 and a particulate filter 110 may be fastened together (whether at the factory, or by a user), so that they can be easily handled and installed as a unit. Thus for example, in embodiments in which a prefilter 120 is fibrous in nature, a frame of the particulate filter 110 may be provided with hooks that act in combination with the fibrous prefilter to form a hook-and-loop fastening system that allows the prefilter to be fastened to the particulate filter. It is noted that in embodiments in which a second filter is sufficiently securely fastened or otherwise attached to a particulate filter 110, it may not be strictly necessary that the second filter be positioned upstream of the particulate filter. Thus in some embodiments, a second filter may be provided downstream of the particulate filter, in which case such a filter will be referred to (referencing its position relative to the particulate filter) as a "post-filter". However, it may be advantageous (particularly in instances in which a second filter is relatively flexible) that when an air filter 100 is installed in the filter holder, the second filter is installed as a prefilter, i.e. is sandwiched between the particulate filter 110 and the floor of the air filter holder in such manner that it cannot be easily dislodged.

It is emphasized that in embodiments in which an air filter 100 is a filter assembly that includes a particulate filter 110 and one or more additional prefilters or post-filters, references herein to the properties of an air filter 100, to the manipulation of an air filter 100 (e.g. during installation of the air filter in a room air purifier), and so on, will be understood to refer collectively to the stacked combination of the particulate filter 110 and all prefilters and/or post-filters that are present in that particular assembly. For example, the total thickness of all such items that collectively comprise such an air filter assembly will be used as the thickness of the air filter 100 for purposed of calculating various ratios, as discussed later herein.

Filter Holder

Figure 5:
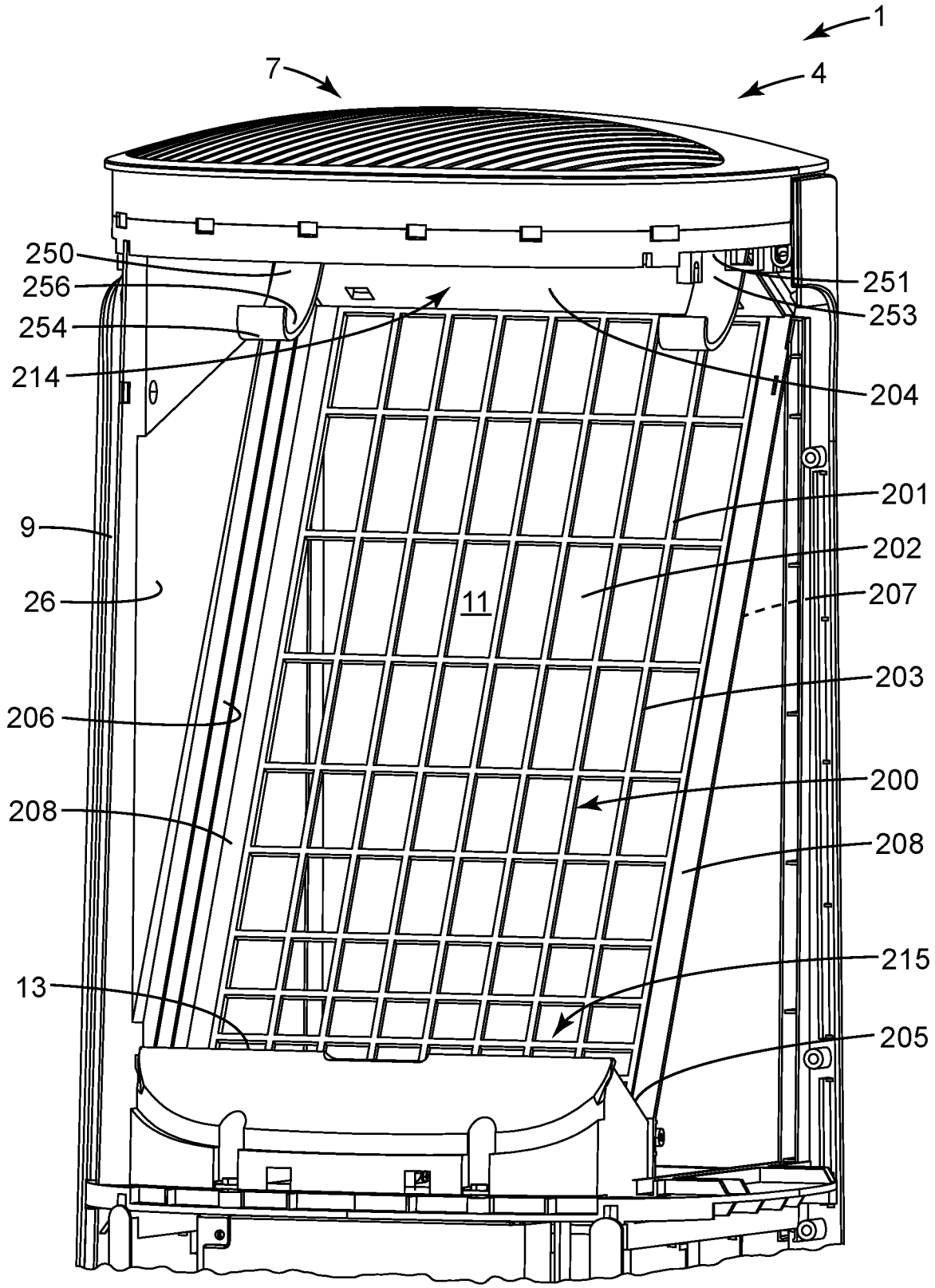
FIG. 5 is a rear-side perspective view of an upper portion of an exemplary room air purifier with a rear cover plate and various other panels and components omitted to show an interior space comprising an exemplary air filter holder.

As shown in FIGS. 3 and 5, room air purifier 1 comprises an air filter holder 200 that is configured to receive a disposable air filter 100 and hold the air filter so that at least the filter media 107 of a particulate air filter 110 of the air filter is in the airflow path through the room air purifier. As most easily visible in FIG. 5 (which is a magnified view of the upper portion of the room air purifier of FIG. 3, with the front panels, latch housing and right-side panels of the room air purifier omitted for easier visualization of the components of the filter holder), filter holder 200 comprises a floor 201 and upper, lower, left and right perimeter walls 204, 205, 206 and 207. These walls collectively circumscribe the floor 201 of the filter holder 200 (noting that the panel of the room air purifier that provides right perimeter wall 207 has been omitted from FIG. 5; a dashed line indicates where this perimeter wall would be). The floor and these perimeter walls thus define a space into which a disposable filter can be received and securely held. Typically the upper and lower walls will be at least generally parallel to each other; similarly, the left and right walls will be at least generally parallel to each other. As disclosed herein, an air filter holder 200 will not comprise any kind of ceiling, whether fixed, movable, or removable. Rather, the space defined by holder 200 is generally upwardly and rearwardly open-ended (as is evident from FIGS. 3 and 5) to allow an air filter 100 to be inserted into the holder through this open-ended space.

At least a major area 202 of floor 201 is air-transmissive, meaning that it comprises through-holes of sufficient size and/or quantity to allow adequate airflow therethrough. In some embodiments, area 202 of floor 201 may comprise a set of members 203 that form a grid with multiple openings therethrough. However, the air-transmissive area of the floor may take any suitable form, e.g. it may comprise a metal or polymeric mesh or screen, or; in general, any sheet-like structure or material that exhibits an appropriate combination of mechanical rigidity and air-transmissibility. In some embodiments, air-transmissive area 202 of floor 201 may be at least partially surrounded by a picture-frame border 208 configured to receive and abut at least portions of a support frame 103 of the disposable air filter 100.

By definition, air filter holder 200 is non-movable. By this is meant that holder 200 is fixedly attached, connected, etc. to the room air purifier 1 so that in ordinary use of the room air purifier, and in particular during the process of removing a spent air filter from the room air purifier and installing a fresh air filter in the room air purifier, holder 200 as a whole remains fixed in position relative to the room air purifier.

Such an air filter holder will be contrasted with, for example, a receptacle (e.g. a tray of the general type depicted in FIG. 4 of U.S. Pat. No. 7,537,647 or in FIGS. 2-4 of US Patent Application Publication US20100000413) that is configured to be removed from a room air purifier, a spent air filter removed therefrom, a fresh air filter inserted thereinto, and then re-inserted into the room air purifier. Furthermore, by non-movable is meant that none of the various components of the holder (including all of the walls, and the floor) move relative to each other during removal or insertion of a filter into the holder (for example, a wall of the holder is not hinged so that it can be opened to allow the filter to be inserted into the holder). Still further, by non-movable is meant that no part or component of the filter holder is configured to e.g. oscillate, vibrate, shake, or otherwise move to any extent, during ordinary operation of the room air purifier. Such an air filter holder will be contrasted to, for example, an entity that is configured to be purposefully vibrated during operation of a room air purifier in order to dislodge particles from an air filter that is in contact with the entity.

In some embodiments, floor 201 of air filter holder 200, and the upper, lower, and left and right perimeter walls 204, 205, 206 and 207 of the air filter holder, are not portions of a single, unitary body. By a single, unitary body is meant a holder in which all of the portions are assembled together as a unit before being incorporated into the room air purifier. A single, unitary body encompasses a filter holder that is molded as a single, integral unit, and also encompasses a filter holder in which various separately-made components are separately made and are assembled together to form a completed, unitary filter holder that is then installed into a room air purifier.

For example, the exemplary air filter holder 200 as depicted e.g. in FIG. 5 is not a single, unitary body. Rather, the floor and the various walls of the air filter holder are provided by portions of various, separate components of the powered room air purifier, which portions combine to collectively provide the air filter holder. For example, as shown in FIG. 5, the left perimeter wall 206 of the filter holder is provided by an inward-facing surface of a panel 26 of housing 9 of the room air purifier. (The right perimeter wall is similarly provided, but this panel and wall are omitted from FIG. 5). The floor 201 of the filter holder is a piece that is separately made from all of the perimeter walls, and that may be e.g. attached to one or more of the perimeter walls. Or, floor 201 may actually be attached to one or more components of the room air purifier other than the perimeter walls, but will nevertheless be positioned (e.g. abutted against the various perimeter walls) so that filter holder 200 is formed by these items in combination.

Figure 6:
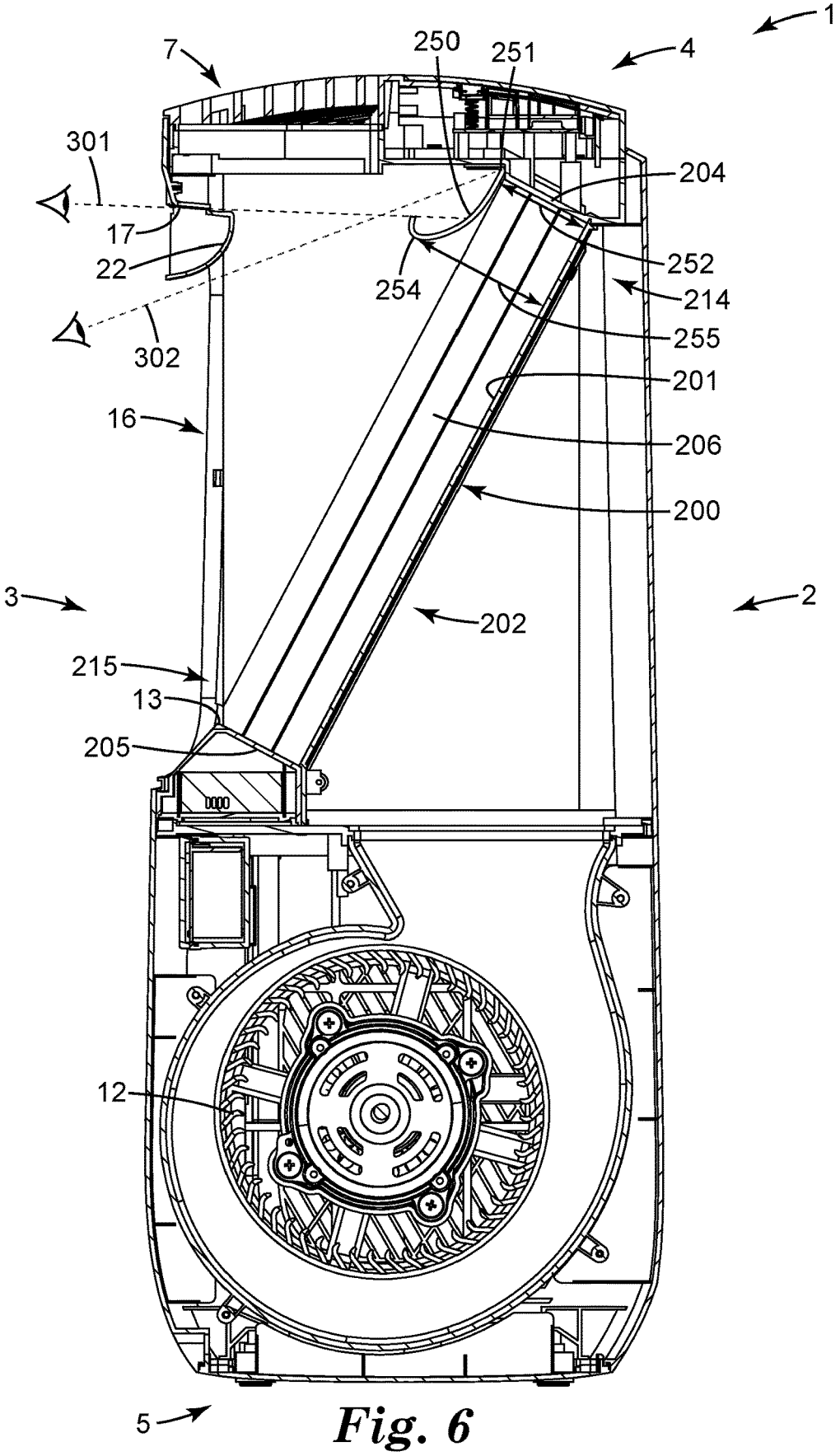
FIG. 6 is a side cross-sectional schematic view of an exemplary room air purifier.

Air filter holder 200 is forwardly angled, as evident in FIG. 5 and as is more quantitatively ascertainable in the cross-sectional side view of FIG. 6. By forwardly angled is meant that the upper end 214 of filter holder 200 is positioned further forward (i.e., further away from the opening 16 exposed by opening cover plate 8) than is the lower end 215 of holder 200. The forward angle of filter holder 200 can be most easily characterized by way of a major plane of floor 201 of holder 200. In various embodiments, floor 201 may exhibit a major plane that is forwardly angled at least 10, 15, 20, 25, 30, or 35 degrees relative to a vertical axis of the room air purifier (when the room air purifier is positioned on a horizontal surface, in ordinary operating configuration). In further embodiments, floor 201 may exhibit a major plane that is forwardly angled at most 50, 40 or 30 degrees relative to this vertical axis. By way of a specific example, the floor 201 of exemplary filter holder 200 of FIG. 6 comprises a major plane that is forwardly angled approximately 25-30 degrees relative to the vertical axis of the room air purifier.

An air filter holder 200 configured in this manner will position an air filter 100 so that the air filter (characterized by way of a major plane of the air filter) is forwardly angled at an orientation established and defined by the air filter holder. Positioning an air filter at such an angle can allow an air filter that is longer (and thus has a greater total surface area) to be installed in an interior space of a room air purifier, while still providing that fan-impelled air impinges on the upstream face of the air filter at an angle that is satisfactory for ensuring airflow through the air filter media. In other words, such arrangements allow the largest possible filter to be used while not causing the airflow to impinge on the filter at an angle that is e.g. unacceptably glancing or tangential to the filter.

As is evident from FIG. 6, the arrangement of air filter holder 200 within interior space 11 of the room air purifier may cause upper end 214 of filter holder 200 to not be easily, or at all, visible to a person who is installing an air filter 100 into holder 200. That is, when looking through opening 16, if the person's eyes are approximately level with or slightly above the upper edge 17 of opening 16, the person may not be able to see upper end 214 of holder 200. By way of a specific example, the line of sight numbered 301 in FIG. 6 is oriented at an angle in the range of approximately 2-3 degrees downward relative to horizontal. Along this line of sight, upper end 214 of holder 200 is obscured by the portions of housing 9 that upwardly bound upper edge 17 of opening 16, so that the person is not able to see upper end 214 of holder 200 through opening 16. (The upper end 214 of holder 200 may also be at least partially obscured by a latch housing of the type described previously, if such an item is present.) In contrast, the line of sight numbered 302 is oriented at an angle of approximately 20 degrees upward; along this line of sight, the person is able to see the upper end 214 of holder 200 through opening 16. Thus in some embodiments, with the room air purifier in an upright orientation with cover plate 8 fully open to fully expose opening 16 to its maximum extent, the first, proximal end 251 of guide ramp 250 may not be visible through opening 16 unless viewed along a line of sight that is angled less than 15 degrees downward. (Alternatively phrased, in such embodiments end 251 will not be visible when viewed along a line of sight that is angled 15 degrees or more downward.) In further embodiments, end 251 (at upper end 214 of holder 200) may not be visible unless viewed along a line of sight that is angled less than 5 degrees downward, that is angled less than horizontal; or, that is angled at least, 5, 10, or 15 degrees upward.

The consequences of this are that, unless a person positions themself very low in relation to the room air purifier (e.g. by either sitting on the floor or lifting the room air purifier up onto a table), the person may be attempting to install an air filter "blind"; that is, without being able to see the entirety of the space into which the filter is to be inserted.

Guide Ramp

In view of this, in some embodiments room air purifier 1 may comprise one or more guide ramps 250 to aid in guiding an air filter into position in air filter holder 200. Exemplary guide ramps 250 are depicted in exemplary embodiment in FIG. 5; one such guide ramp is visible in side cross-sectional view in FIG. 6. Any such guide ramp will be located at an upper end 214 of air filter holder 200 (with the term "at" being used to denote any location proximate this upper end). As shown in FIGS. 5 and 6, a guide ramp 250 will comprise a first, proximal end 251 that is located proximate upper perimeter wall 204 of filter holder 200 and that is spaced apart from floor 201 of filter holder 200 a first distance 252 (as indicated in FIG. 6). The guide ramp will comprise a second, distal end 254 that is spaced apart from floor 201 of filter holder 200 a second distance 255 (also as indicated in FIG. 6). The second distance 255 will be greater than the first distance by at least 20%. This ratio is calculated with the first distance as a basis; e.g. if distance 252 is 4 cm and distance 255 is 5 cm, the ratio is (5-4)/4 or 25%. In various embodiments, this ratio may be at least 30, 40, or 50%; in further embodiments, this ratio may be at most 100, 80, 60, 45, or 35%.

These distances may be chosen with respect to the thickness of an air filter (that is, the total thickness of the air filter, at a location proximate the perimeter of the air filter). For example, the first distance 252 may be chosen so that it is e.g. no more than 2, 5, or 10% greater than the thickness of an air filter 100 that is to be installed in the air filter holder, so that the air filter, when fully inserted into the air filter holder, will be held snugly between the proximal end of the guide ramp and the floor of the air filter holder. Conversely, the second distance 255 may be chosen to be greater than the thickness of the air filter 100, by a factor of at least 15, 20, 25, or 30%, so that the air filter may be more easily inserted between the distal end of the guide ramp and the floor of the air filter.

In embodiments in which an air filter 100 is in the form of a stack comprising a particulate filter 110 and e.g. at least one prefilter 120, the thickness of the air filter 100 as used in the above calculations will be the total thickness of the stack. In some embodiments (e.g. in which the use of a prefilter 120 is optional) it may be useful that a guide ramp be configured to be able to accommodate the presence or absence of a prefilter. That is, the guide ramp may be configured so that it will hold a particulate filter 110 securely in the absence of a prefilter 120 but is nevertheless able to accept and hold a stack comprising the particulate filter 110 and a prefilter 120. In such embodiments it may be advantageous that the thickness of the prefilter (or multiple prefilters in combination) be a small fraction of the thickness of the particulate filter. Thus in various embodiments, the thickness of a prefilter 120 may be less than 20, 15, 12, or 10% of the thickness of the particulate filter with which the prefilter is to be used. In particular embodiments, a particulate filter may be ~45 mm in thickness, and an accompanying prefilter may be 4-5 mm in thickness.

Such a guide ramp can act generally as a funnel to direct a leading end of an air filter into upper end 214 of the air filter holder 200. This can advantageously enhance the degree to which the filter holder is "forgiving" in the instance that an air filter is slightly misdirected, e.g. too far upward, in a filter-installation process. This can be particularly advantageous in the instance that the air filter is being installed "blind", with the person not able to see exactly where the leading end of the filter needs to go.

A guide ramp may comprise any useful length (e.g. from at least 1, 2 or 3 cm, to at most 10, 8 or 6 cm) from its proximal end to its distal end. A guide ramp 250 can comprise any suitable design and can be present in any suitable number. In some embodiments a single guide ramp may be present, e.g. centered on the transverse midpoint of the upper end 214 of the air filter holder 200. In various embodiments such a guide ramp may extend e.g. continuously across at least 20, 40, 60, 80, 90, or 100% of the transverse extent (width) of the upper end of the air filter holder. In other embodiments multiple guide ramps may be used, e.g. spaced across the transverse extent of the upper end of the air filter holder. For example, in the exemplary embodiment of FIG. 5, two guide ramps 250 are used, one at each upper corner of the air filter holder. In some embodiments, a guide ramp may be formed (e.g. molded) along with, e.g. as an integral part of, some component of filter holder 200. For example, a guide ramp may be molded along with a panel that provides upper perimeter wall 204 of filter holder 200. In some embodiments, one guide ramp may be molded as part of a panel that provides left perimeter wall 206 of holder 200, and another guide ramp may be molded as part of a panel that provides right perimeter wall 207 of holder 200. In other embodiments, a guide ramp may be a separately-made piece that is attached (whether by mechanical fastening such as with screws or bolts, or by ultrasonic welding, adhesives or tapes, etc.) to a component of the room air purifier, e.g. to a component of filter holder 200.

As noted above, an end 254 of a guide ramp that is distal to the upper perimeter wall 204 of holder 200 will be spaced further from floor 201 of holder 200, than an end 251 of the guide ramp that is proximal to wall 204. In some embodiments, at least a distal portion 256 of guide ramp 250 may be arcuately curved away from floor 201 of filter holder 200, as in the exemplary design of guide ramp 250 depicted in FIG. 6. In some embodiments, this curvature may be greater in the distal portion 256 of the guide ramp than in a proximal portion 253 of the guide ramp (portions 253 and 256 are indicated in general in FIG. 5). In other words, in some embodiments a guide ramp may exhibit a generally scroll-like shape in which a proximal portion of the guide ramp is rather flat, to ensure that this portion of the guide ramp securely holds an installed air filter, with a distal portion of the guide ramp curving away from the floor of the air filter holder, to allow the upper end of an air filter to be more easily inserted into the space between the guide ramp and the holder floor. An exemplary version of such an arrangement is shown in FIGS. 5 and 6.

In various embodiments, a distal portion 256 of a guide ramp may exhibit a local radius of curvature that, at least at some point along the distal portion, is smaller than e.g. 15, 10, 5, 2, or 1 cm. In further embodiments, a proximal portion 253 of the guide ramp may exhibit a local radius of curvature that, at least at some point along the proximal portion, is greater than e.g. 3, 6, 12, or 20 cm. Whatever the absolute value of these parameters, in such embodiments the radius of curvature of the distal portion will be smaller than the radius of curvature of the proximal portion. In various embodiments, the radius of curvature of the distal portion will be no more than 0.8, 0.6, 0.3, or 0.1 of the radius of curvature of the proximal portion, at least at some locations of the two portions. In some embodiments, proximal portion 253 or a part thereof (e.g. a part closest to the proximal end 251 of ramp 250), may exhibit a radius of curvature of essentially infinity; that is, this portion of the guide ramp may be essentially planar. It is noted that all such radii of curvature, the above-discussed distance ratios, and so on, will be evaluated using the "contact" surface of the guide ramp; that is, the surface of the guide ramp that an inserted air filter is able to come into contact with. (Over most of the length of guide ramp 250, this will be the surface of the guide ramp that faces toward the floor of the filter holder.)

In some embodiments a distal portion 256 of a guide ramp may curve to such an extent that a terminal section of this portion of the guide ramp actually bends back toward the proximal end 251 of the guide ramp, as in the exemplary design of FIG. 6. Such a design can provide that in the event that an air filter comprising pleated filter media is inadvertently misdirected too for upward, the pleats of the filter media are unlikely to become hung up or caught on the terminal end (the tip) of the guide ramp such that the filter cannot be easily withdrawn. It is noted that if a guide ramp 250 is of a design in which a terminal section of the distal portion 256 of the guide ramp curves back in this manner, the above-described distance 255 that the distal end of the guide ramp is spaced apart from the floor of the guide ramp will be measured at the point of the guide ramp that is farthest from upper perimeter wall 204 of filter holder 200, along a path that is parallel to floor 201 of holder 200. In other words, this farthest point will be considered to be the distal end 254 of the guide ramp for purposes of measuring this distance, as can be appreciated by inspection of location 254 and distance 255 as indicated in FIG. 6.

In some embodiments a guide ramp 250 may be rigid, meaning that the distal end of the guide ramp will not deflect more than 0.5 cm in the event that a leading end of an air filter is impinged on any portion of the guide ramp while being manually inserted into the filter holder by a person. In some embodiments a guide ramp 250 may be deflectable, meaning that the distal end of the guide ramp will momentarily deflect more than 0.5 cm in such an instance (while a proximal portion 253 of the guide ramp may hardly deflect at all). Any such deflectable guide ramp can, for example, make the guide ramp more forgiving in an installation process in which an air filter is slightly misdirected. A guide ramp as disclosed herein (whether rigid or deflectable) is distinguished from a clamp or fastener that is purposefully actuated (whether by hand or e.g. by a remote switch) between a first (e.g. open) position in which it allows entry of an air filter, and a second (e.g. closed) position in which it holds the air filter in place (and, if no air filter is present, will not allow an air filter to be inserted into place).

A deflectable guide ramp may be particularly useful in embodiments in which the guide ramp needs to able to accommodate the insertion of first type of air filter in the form of a particulate filter 110 alone, and also needs to accommodate the insertion, if desired, of a second type of air filter in the form of the particulate air filter 110 along with at least one prefilter 120. Such deflectability, may, for example, allow either type of air filter to be inserted and to be held securely.

In particular embodiments in which an air filter 100 is at least somewhat compressible (e.g. by way of comprising a prefilter 120 in the form of a compressible, resilient non-woven web) the previously-described first distance 252 (measured in the absence of any air filter) established by a guide ramp 250 may be slightly less than the total, nominal (uncompressed) thickness of the air filter 100. This can enhance the tightness with which the air filter is held between the guide ramp 250 and the floor 201 of the filter holder. In various embodiments, this first distance 252 (measured in the absence of any air filter) may be at most 100, 98, 96, 94, 92 or 90% of the total nominal filter thickness. In further embodiments, first distance 252 may be at least 89, 91, 93, 95 or 97% of the total nominal filter thickness.

Thus in at least some embodiments, guide ramp 250 may be biased toward the floor 201 of filter holder 200. This can provide that at least a part of a proximal portion 253 of the guide ramp 250, rather than merely abutting the downstream face of an air filter installed in the filter holder, may apply pressure on the downstream face of an air filter 100 installed in the holder to hold the air filter in place between the guide ramp and the floor of the holder.

In some embodiments a guide ramp (in particular, a proximal portion 253 of the guide ramp that closely abuts an installed air filter) may be air-transmissive (e.g., the guide ramp may be perforated or the like).

Figure 7:
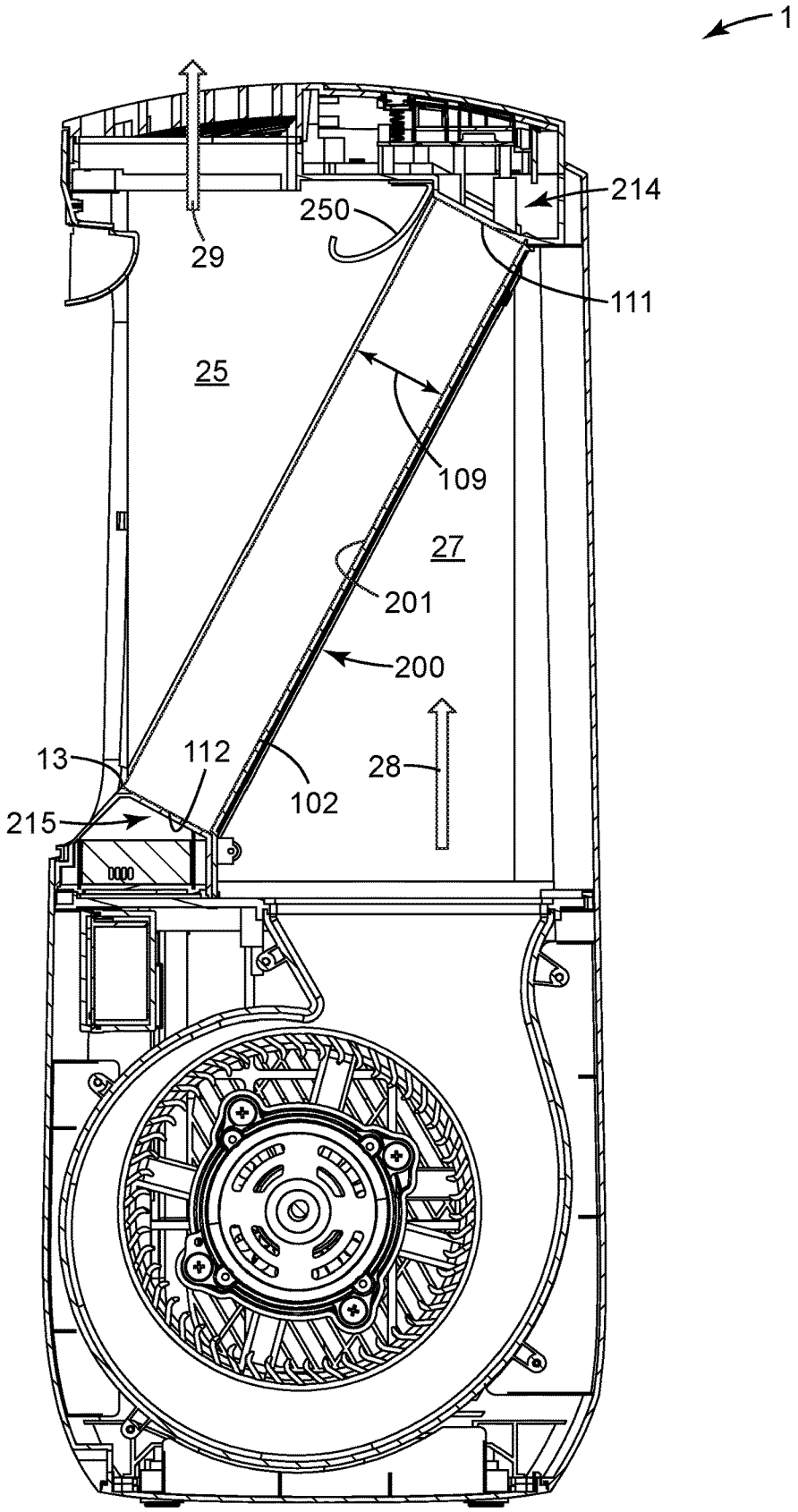
FIG. 7 is a side cross-sectional schematic view of an exemplary room air purifier with a disposable air filter installed into an exemplary air filter holder of the room air purifier.

An air filter 100 can thus be installed into an air filter holder 200 to arrive at an arrangement of the general type shown in FIG. 7, in which an upstream face of the air filter is abutted against floor 201 of holder 200, and with the various peripheral sidewalls of the air filter being abutted against the various perimeter walls of the air filter holder. It is noted that FIGS. 7 and 9-11 depict embodiments in which, no prefilter (or post-filter) being present, air filter 100 consists of a particulate filter 110 (thus, face 102 of filter 110 provides the upstream face of air filter 100). The cover plate 8 whose opening allowed the air filter to be inserted into the interior space 11 of the room air purifier can then be closed. In some embodiments, one or more features can be provided, e.g. connected to, or as a part of, cover plate 8, to enhance the secureness with which the air filter is held in the air filter holder.

Figure 8:
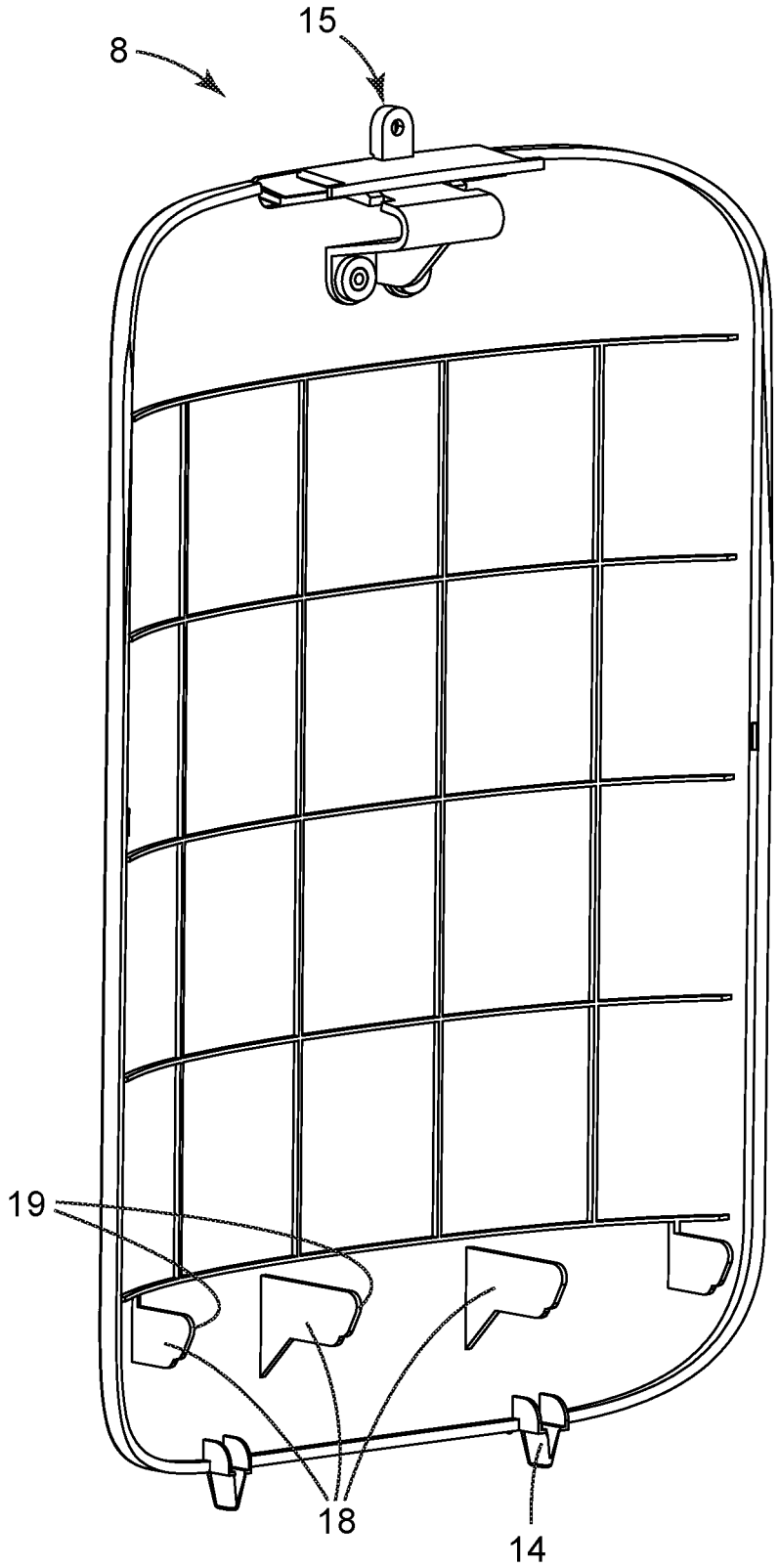
FIG. 8 is a perspective view of an inward-facing side of an exemplary cover plate of a room air purifier.
Figure 9:
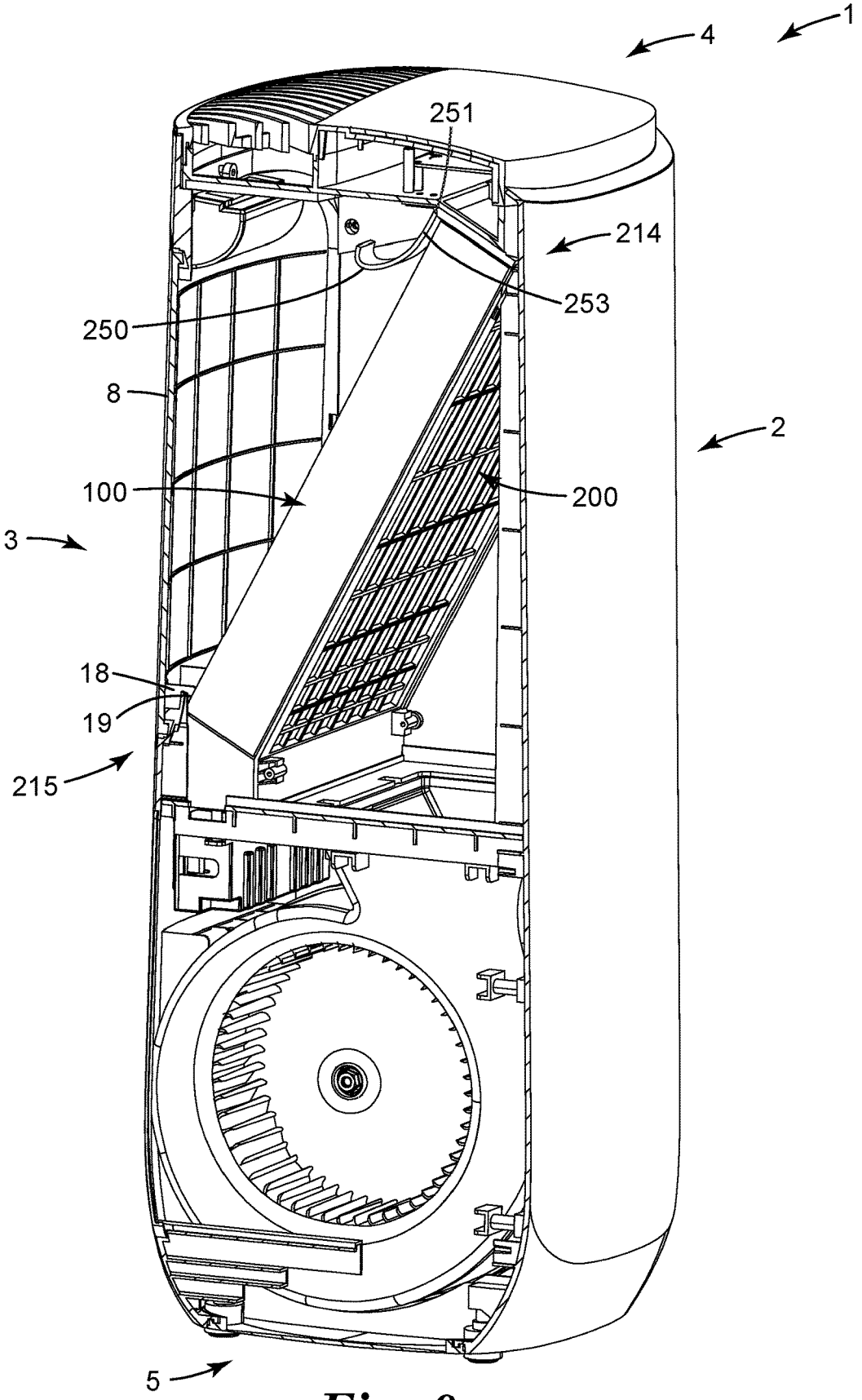
FIG. 9 is a front-side perspective view of an exemplary room air purifier with a disposable air filer installed into an exemplary air filter holder of the room air purifier and with a cover plate in position on the room air purifier.

For example, in some embodiments room air purifier 1 may comprise at least one movable filter-abutting structure 18 as shown in exemplary embodiment in FIG. 8, which shows the inward-facing side of an exemplary cover plate 8. Such a structure can be configured so that when the cover plate is closed (reinstalled into opening 16) a forward abutting surface 19 of structure 18 may abut at least a portion of lower end 112 of air filter 100. Such an arrangement is visible in FIG. 9, which depicts (with various panels of the room air filter omitted) an air filter as installed into a filter holder 200, with cover plate 8 having been closed. As shown in FIG. 9, filter-abutting structure 18 can serve to securely hold the lower end 112 of filter 100 in place. And, the proximal end 251 of guide ramp 250 can serve to securely hold the upper end 111 of filter 100 in place. The guide ramp(s) and filter-abutting structure(s) can thus act in combination to hold an air filter 100 in place within interior space 11 of a room air purifier.

It will be appreciated that even were an air filter 100 to become dislodged within interior space 11, cover plate 8 would likely keep the air filter from being ejected from the room air purifier. However, even a relatively small displacement of the air filter from its fully-seated position in holder 200 might cause air leaks around the edges of the air filter, might cause the filter to rattle, or might cause any number of other unwanted effects. The herein-disclosed arrangements thus advantageously allow for easy loading of an air filter into a room air purifier (as discussed in detail later herein) while still allowing the installed air filter to be securely held in place.

By a filter-abutting structure 18 being movable is meant that such a structure is movable by way of being attached or connected to a cover plate 8 that is itself movable (whether e.g. hingedly openable, or completely removable from the room air purifier). In some embodiments, such a filter-abutting structure 18 will not be movable with respect to the cover plate 8 to which it is connected. Rather, such a structure may be fixedly attached to a forward (interior) surface of the cover plate. In some embodiments (e.g. as in the exemplary design of FIG. 8) such a structure may integrally extend from (e.g., may be molded as a part of) a cover plate 8. Such a filter-abutting structure 18 need not necessarily protrude inwardly from the area of the inward-facing surface of a cover plate 8 that surrounds the structure 18 in the manner of FIG. 8. Rather, in some embodiments a large area of the lower portion of the cover plate may be positioned so that a portion of the area serves as a forward-abutting surface.

Any suitable number of such filter-abutting structures 18 may be used. In some embodiments a single structure 18 may be present, e.g. centered on the transverse midpoint of a lower portion of cover plate 8. In various embodiments such a structure may extend e.g. continuously across at least 20, 40, 60, 80, 90, or 100% of the transverse extent (width) of the lower portion of the cover plate. In other embodiments multiple filter-abutting structures may be used, e.g. spaced across the transverse extent (width) of the cover plate. In the exemplary embodiment of FIG. 8, two filter-abutting structures 18 are present, that, when cover plate 8 is in place, abut the lower right and lower left corners of the installed air filter. Two additional filter-abutting structures 18 are also visible in FIG. 8, spaced transversely along cover plate 8. Here and elsewhere, by an item "abutting" a neighboring item is meant that the two items are positioned within 3 mm of each other at their point of closest approach. In various embodiments, abutted items may be positioned within 2, 1.0, or 0.5 mm of each other. In many cases, abutted items may be in actual contact with each other.

Installing an Air Filter

Figure 10:
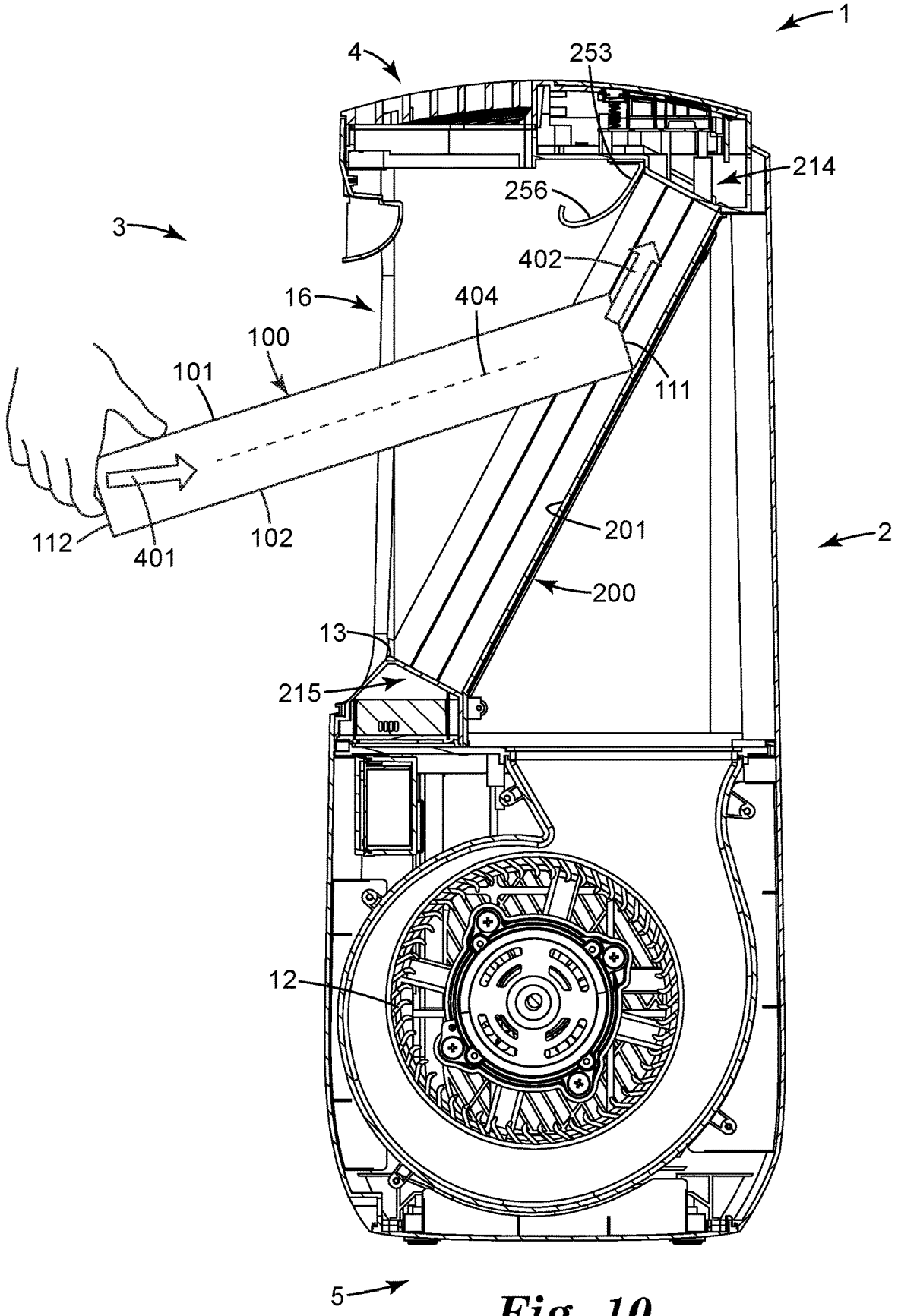
FIG. 10 is a side cross-sectional schematic view of an exemplary room air purifier with a disposable air filter partially inserted thereinto.

The herein-disclosed air filter holder 200 is configured to maximize the ease with which an air filter 100 can be installed in the room air purifier. The installation can be performed by manually grasping the air filter (typically, by grasping a rearward (trailing) end 112 of the air filter as shown in FIG. 10) and performing a combination of the following steps. One step is that of translationally moving air filter 100 inwardly through opening 16 in housing 9 of room air purifier 1 so that the upper end 111 of air filter 100 moves forwardly and/or upwardly into interior space 11 of room air purifier 1. This step is illustrated in generic, exemplary manner in FIG. 10. Another step is that of rotating the air filter 100 about a rotation axis that is aligned with a transverse direction (width) of air filter 100 so that the lower end 112 of air filter 100 moves forwardly and downwardly. This step is illustrated in exemplary manner in FIG. 11.

These steps are performed in a manner sufficient to install air filter 100 into air filter holder 200; that is, to move the air filter into an air-filter-receiving space defined by the air filter holder. It is emphasized that these steps may be performed any number of times, in any order, in the performing of the installation. In some instances the steps can be performed sequentially. (That is, at some point in time during the installation process the air filter may be being moved translationally while not being rotated, or vice versa.) The two steps do not necessarily have to be alternated (rather, in some instances two consecutive translational movements, e.g. along different slopes, may be performed without a rotation step occurring therebetween). In some instances the two steps can be performed simultaneously; that is, the air filter may be moved translationally while also being rotated.

By moving translationally and like terms is meant that an air filter is being moved in a direction as a whole; for example, is being slidably moved in the general manner shown in FIG. 10 (it will be appreciated that in the particular motion shown in FIG. 10, some slight rotation of the air filter may also occur). By rotating, rotatably moving, and like terms, is meant moving an air filter about an axis of rotation that is aligned with a transverse (left-right) direction of the filter so that one end of the filter moves upward (or downward) with respect to the other end of the filter.

In further detail, the installation of an air filter 100 (with cover plate 8 having been opened), will be preceded by manually grasping the air filter. The installation process, and in particular the performing of the above-recited steps, is considered to begin when the upper end 111 of the air filter 100 first enters opening 16 to penetrate into interior space 11. It will be appreciated that the end 111 of air filter 100 that first enters opening 16 (i.e., the "leading" end of the filter) is, during the loading process, typically located upward and forward in relation to end 112 that is grasped (i.e., the "trailing" end). For consistency of description, end 111 will be referred to as the "upper" end of the air filter and end 112 will be referred to as the "lower" end of the air filter. It will however be understood that an air filter 100 may occasionally be held with these ends in any of various arrangements and relative positions.

Thus, in an installation process, an air filter can be grasped and translationally moved so that the upper end 111 of the filter enters opening 16. The translational movement of the air filter can be continued so that the air filter reaches the position shown in FIG. 10. At this point the upper end 111 of the air filter 100 may contact floor 201 of air filter holder 200. Continued force can be applied, e.g. to lower end 112 of air filter 100, in a generally forward (and optionally slightly upward) direction as indicated by arrow 401 of FIG. 10. This will cause the upper end 111 of air filter 100 to follow an upward and rearward path as dictated by floor 201 along which end 111 of air filter 100 slides, as indicated by arrow 402 of FIG. 10.

Figure 11:
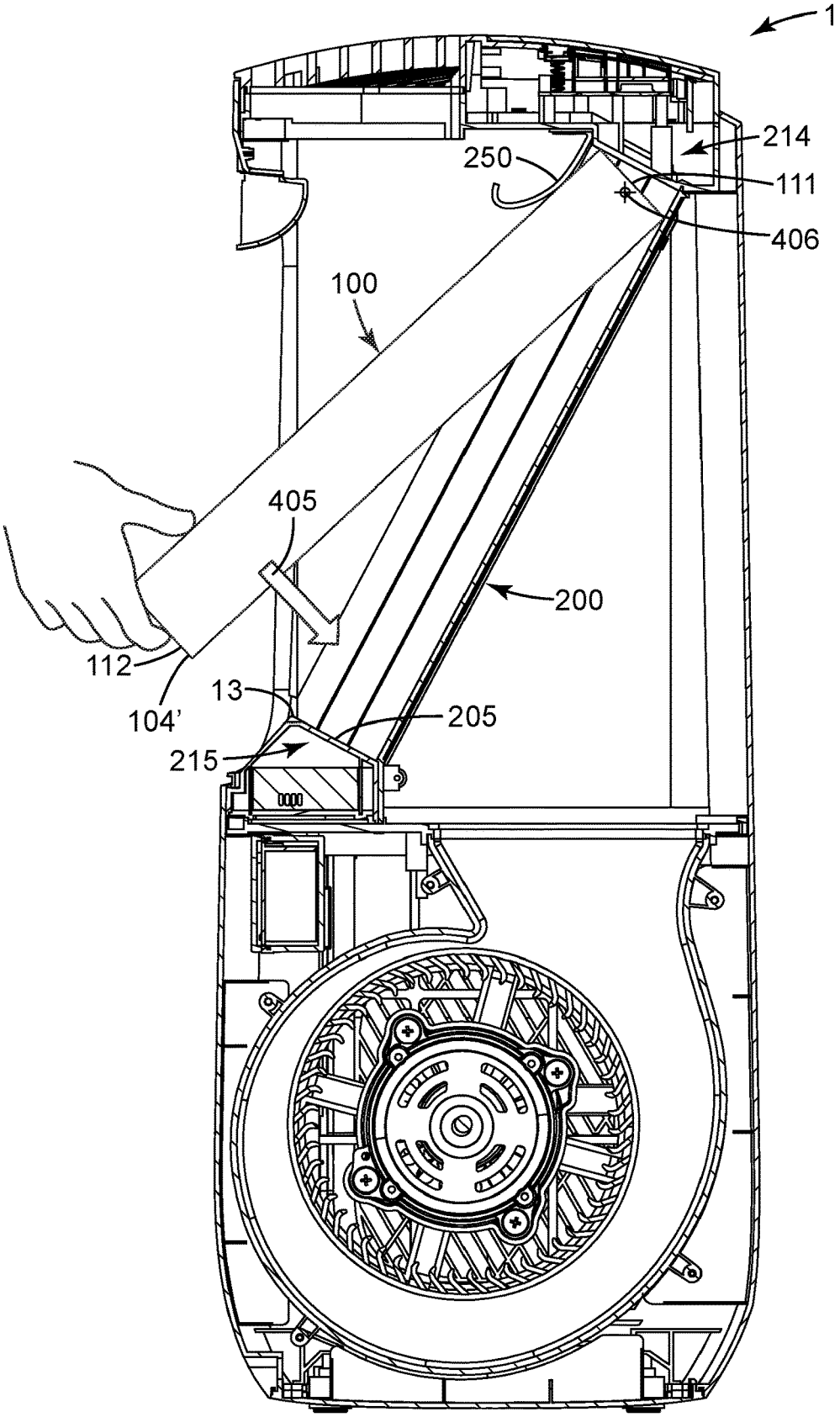
FIG. 11 is a side cross-sectional schematic view of an exemplary room air purifier showing further progress of the insertion of a disposable air filter thereinto.

At one or more times during this translational movement of air filter 100 deeper into the interior of the room air purifier, air filter 100 may be rotatably moved; e.g., lower end 112 of air filter 100 may be rotated downward in the general manner indicated in FIG. 11. In some embodiments a translational movement of the air filter may be stopped (one or more times) while a rotational movement is performed; however, in many cases it may be convenient for the translational and rotational movements to be performed simultaneously at one or more times. For example, the air filter may be slidably pushed forward so that the upper end 111 of the air filter continues upward and forward, with the lower end 112 of the air filter being gradually rotated downward during this time. It will be appreciated that the design of the room air purifier 1 (and, in particular, of the air filter holder 200) is such that the installation of an air filter 100 into holder 200 cannot be performed by performing only translational motion or only rotational motion.

Whatever the number, order and/or magnitude of each motion that is carried out at any particular point in the process, the air filter will eventually be brought into a condition represented generically by FIG. 11. A final step that is a rotation step must then be performed to finish the installation of the filter into the holder. Thus, a final step will be one in which the air filter, as motivated by a force indicated by arrow 405, is rotated about a rotation axis 406 that passes through the upper end 111 of the air filter. This moves the lower end 112 of the air filter forwardly and downwardly so that a lower peripheral sidewall 104' of the lower end of the air filter abuts a lower perimeter wall 205 of the air filter holder. The result of this final step will be that the filter rests in the filter holder in the manner shown in FIG. 7. (The term "final" is used only with respect to the actual installation of the filter and permits a subsequent act of refitting the cover plate 8 in place on the room air purifier.)

In some embodiments, a penultimate step (i.e., a step immediately prior to the final step) may be a translational motion step. This step may result in the upper peripheral sidewall 104 of the upper end of the air filter approaching (e.g. within 10, 5, or fewer mm) the upper perimeter wall 204 of the air filter holder. More importantly, this step will result in the lower peripheral sidewall 104' of the lower end 112 of the air filter being clear of the upper terminus 13 of the lower perimeter wall 205 of the air filter holder so that the lower end of the air filter can be moved in the above-described final step of the installation without hitting (being blocked by) terminus 13 of wall 205.

During an above-described air filter installation process, the upper end 111 of the air filter will follow an overall upward and forward path toward the upper end 214 of the air filter holder, that is non-linear. The term non-linear encompasses a path that, for example, includes two segments that are each linear but that exhibit different slopes. For example, an air filter may be moved into opening 16 so that upper end 111 of the filter travels forward along a first straight (e.g. approximately horizontal) segment, until end 111 hits floor 201 of holder 200. After that, end 111 will travel forward and upward (guided by floor 201) along a second segment that is also straight but that exhibits a higher upward slope than the first segment. The two segments, even though each may be linear, combine to form a non-linear path. Alternatively, a person may insert air filter 100 into opening 16 while manually guiding filter 100 so that its upper end 111 travels along an upwardly-curved, i.e. non-linear, path until it eventually contacts floor 201 (after which end 111 may travel along a straight path). In actual practice, of course, a person may insert an air filter so that it follows any of various combinations of straight path segments and arcuate path segments during the installation. All such variations are encompassed by the above definition of the overall path that is followed by the upper end of the air filter during the installation process, as being non-linear.

At least at some point during the installation process, an angular offset may be present between the direction along which a motivating force is applied to the lower end 112 of the air filter, and the path that the upper end 111 of the filter moves along. That is, as shown in exemplary embodiment in FIG. 10, during a translational movement of the air filter, the direction that the upper end 111 of the air filter moves along (as indicated by arrow 402) may be upwardly offset from e.g. 20 to 70 degrees relative to the direction along which the motivating force is applied to the lower end 112 of the air filter (as indicated by arrow 401). In various embodiments, this upward angular offset may be e.g. from 30 to 70 degrees, e.g. from 40 to 60 degrees. By way of a specific example, in the exemplary illustration of FIG. 10 the upward angular offset of path 402 relative to motivating force 401 is in the range of approximately 55-60 degrees.

Similarly, at least at some point during the installation process, an angular offset may be present between the path that the upper end 111 of the filter moves along, and a major plane of the air filter. That is, as shown in exemplary embodiment in FIG. 10, the direction that the upper end 111 of the air filter moves along (as indicated by arrow 402) may be upwardly offset from e.g. 20 to 70 degrees relative to the major plane 404 of the air filter. In various embodiments, this upward angular offset may be e.g. from 30 to 50 degrees. By way of a specific example, in the exemplary illustration of FIG. 10 the upward angular offset of path 402 relative to major plane 404 is in the range of approximately 45 degrees.

It will be evident that the above descriptions (and FIGS. 7 and 9-11) pertain to an exemplary embodiment in which an air filter 100 consists of a particulate air filter 110. The descriptions apply in similar manner to installation of an air filter 100 that comprises a particulate air filter 110 and at least one prefilter or post-filter. In such a case, the desired items may simply be arranged into a stack, which is then grasped and manipulated in similar manner as described above. Even if a particulate filter 110 and a prefilter 120 are not perfectly aligned with each other as grasped, the insertion of the stack into filter holder 200 will naturally cause the items to become aligned, which is a further advantage of the herein-disclosed arrangements. Of course, if desired a user may first insert a prefilter into the filter holder 200 so that the prefilter rests on the floor 201 of the filter holder, after which a particulate filter 110 may be inserted in the general manner described above. Whichever approach is used, the arrangements disclosed herein make it easy and straightforward to install a filter that is in the form of a multi-item stack, without requiring extremely precise manipulation of the individual items and/or without necessarily requiring that the items must be attached to each other in order to perform the installation.

The above descriptions make it clear that the installation of an air filter as described herein causes the air filter, after installation, to be at an angle relative to both the vertical axis and the horizontal axis of a room air purifier rather than being aligned with either of these axes. Such arrangements will be contrasted with many conventional arrangements in which an installed air filter is aligned exactly along the vertical axis of a room air purifier.

Moreover, the above-described installation process involves a combination of directionally-varying translational and rotational movements of the air filter; and, may often involve sliding the air filter along a direction that is not aligned parallel to, or normal to, a major plane of the air filter, as discussed in detail above. Such arrangements differ from certain filter-installation procedures in the art in which an air filter is slidably moved into place along a single, unvarying direction that is substantially aligned with the major plane of the air filter (e.g. as in the arrangements depicted in FIG. 4 of U.S. Pat. No. 7,537,647 or in FIGS. 2-4 of U.S. Patent Application Publication 20100000413). Such arrangements also differ from certain filter-installation procedures in the art in which an air filter is slidably moved into place along a single, unvarying direction that is oriented substantially normal to the major plane of the air filter (e.g. as in the arrangements depicted in FIG. 4 of U.S. Pat. No. 6,685,760 or in FIGS. 2-3 of U.S. Patent Publication 20190107302).

It will be understood from the discussions above that the herein-disclosed arrangements provide for simple and straightforward loading of an air filter into a room air purifier. For example, some room air purifiers of the art have included a movable (e.g. removable) tray that must be removed from the interior of the room air purifier, an air filter inserted thereinto, and the tray then reinserted into the interior of the room air purifier. The present arrangements are much simpler by virtue of not relying on any such movable tray or holder. That is, in the methods disclosed herein, an air filter is not placed in any kind of movable or removable tray (or any like component of a room air purifier) in order to be installed into the room air purifier.

Moreover, some room air purifiers of the art have required an air filter to be inserted e.g. into a narrow slot and/or into a receiving space that necessitates that the air filter must be carefully guided along the proper path into the receiving space. The user must thus position themself to be able to see the leading end of the air filter and to see the path along which the leading end must travel in order to reach its final destination, in order to guide the filter properly. Thus, in some instances (noting that room air purifiers are typically less than two or three feet tall) a user may disadvantageously need to squat down or even sit on the floor (in order to achieve an upwardly-angled line of sight as discussed earlier herein) in order to load the filter into the room air purifier. Still further, some room air purifiers in the art rely on the use of one or more fasteners, clasps, or the like (e.g. movable or actuatable clamps) that must be e.g. opened to allow an air filter to be put in place and/or closed after the air filter is in place. Or, some arrangements in the art may require the user to at least slightly deform the frame of an air filter in order to fit the filter frame under a retaining lip or tab. Such processes can be cumbersome and/or require extra manipulations on the part of the user.

In contrast, the herein-disclosed arrangements allow a user to simply grasp an air filter e.g. toward its trailing end, and move the air filter forward so that the leading end of the air filter enters the interior space of the room air purifier (it will be straightforward to position the air filter in the desired location along the transverse axis of the room air purifier). The user can continue to move the air filter generally forward so that the leading end of the air filter contacts the floor of the air filter holder. After this, continued application of gentle, generally forward pressure by the user will cause the leading end of the filter to be guided upward and forward by the floor of the filter holder, into the correct position. (As noted, in some embodiments the presence of one or more guide ramps may aid this). This can be accomplished even though the user may not be able to see the upper end of the filter holder; and, in some instances, may not even be able to see more than a small fraction of the pathway along which the filter is to travel.

Thus, the herein-disclosed arrangements can allow a user to install an air filter by simply leaning down far enough to insert the filter into the room air purifier in the manner described above, without having to sit on the floor or even to squat down, and without having to hoist the room air purifier onto a table or tilt it. In fact, an air filter can easily be inserted into an air filter holder via a smooth, continuous motion that incorporates the steps described above, even with the use of only one hand if the user is so inclined. It will thus be appreciated that the herein-disclosed arrangements possess significant advantages over the art.

Based on the descriptions above it is evident that a used air filter can be removed by performing the above steps in reverse. The first step will necessarily be a step of rotating the air filter about a rotation axis that passes through an upper end 111 of the air filter so that the lower end 112 of the air filter moves upwardly and rearwardly far enough to clear the upper terminus 13 of the lower perimeter wall 205 of the air filter holder. (In some embodiments this may be aided by equipping the air filter with a pull tab at a location proximate the lower end 112 of the air filter, as noted earlier herein.) After this, the air filter can then be removed from the interior of the room air purifier through any desired combination of translational and/or rotational movements.

In at least some embodiments, the arrangements and methods disclosed herein do not rely on the presence of one or more hangers from which an air filter may be suspended when installed within a room air purifier. Furthermore, in at least some embodiments, they do not rely on any arrangement in which a frame of the air filter, and an air filter holder (or any other entity, retaining device, tray or the like) of a room air purifier, comprise complementary features configured to be mated to each other when the air filter is installed into the room air purifier. Thus, in some embodiments, a frame of an air filter as disclosed herein may consist essentially of only sidewalls (and upstream and/or downstream flanges, if present) rather than comprising one or more of complementary mating features, hooks, eyelets, hangers, orifices, snaps, fasteners, and so on. Such arrangements are thus distinguished from those that rely on mating components such as the "hangers" and "hanger supports" depicted e.g. in FIG. 4 of U.S. Pat. No. 6,685,760.

Powered room air purifier 1 comprises a fan 12 (visible e.g. in FIG. 6). Fan 12 can be of any suitable type, e.g. a centrifugal (squirrel-cage) fan as shown in FIG. 6. The fan can be driven by an electric motor of any suitable type, e.g. a DC or AC motor of the type often used in room air purifiers. In many embodiments, such a centrifugal fan may be located at or near the bottom end 5 of the room air purifier. In some embodiments such a fan may receive unfiltered air that flows in toward the fan in an axial direction, e.g. through one or more inlets 6 and/or 6' as described previously. The fan may then motivate the air upward (as signified by arrow 28 in FIG. 7) toward the installed air filter 100. Air that has passed through the filter media 107 of filter 100 may then exit the room air purifier, e.g. through one or more outlets 7, as indicated by arrow 29 of FIG. 7.

It will be understood that in such arrangements, the interior space 11 of the room air purifier, and hence the airflow path through the room air purifier, will be divided by the air filter into an air space 25 that is downstream of the installed filter 100 that contains filtered air, and an air space 27 that is upstream of the air filter and that contains unfiltered air (in this context, any air that has passed through a screen of the general type mentioned earlier herein but has not passed through filter 100, will be considered to be unfiltered). In the depicted embodiment, the fan 12 is located in upstream space 27 and urges the unfiltered air toward the air filter. This will be contrasted to an arrangement in which a fan is located in a downstream air space and pulls unfiltered air through an air filter toward the fan. In some embodiments, at least some portion (e.g., 20, 40, 60, or 80%, by overall volume) of an impeller of fan 12 will be located vertically underneath some portion of the filter 100. (In the exemplary embodiment of FIG. 6, the majority (e.g. more than 80%) of the impeller of fan 12 is located vertically underneath filter 100.) It will be appreciated that such an arrangement can provide the room air purifier with a low center of gravity that advantageously enhances the ability of the room air purifier to resist being inadvertently tipped over.

By definition, a powered room air purifier is not an I-WAC (heating/cooling) unit. That is, a powered room air purifier is not configured to purposefully alter the temperature of the air that passes through the room air purifier, except for e.g. minor frictional heating or such effects. However, in some embodiments a room air purifier may perform certain other functions in addition to filtering particles. For example, a room air purifier may comprise an air filter that is configured to capture odors, any of various gases or vapors, and so on.

Room air purifier 1 will comprise whatever controls are needed to operate the unit, e.g. various electronics including e.g. a control unit along with whatever ancillary electrical components are needed. The control unit is in operative connection with fan 12 (e.g. so that fan 12 can be turned on and off and operated at different fan speeds if desired), and may also be in operative connection with various controls and switches, monitors, displays and/or indicators, etc., that are provided on or within housing 9 and that allow a user to directly operate room air purifier 1 (e.g., to turn it off or on, to turn the fan speed up or down, etc.). In some embodiments the control unit may also be in operative connection (e.g. by hard-wire or fiber-optic connection) with a communication unit which allows the control unit to wirelessly communicate with an external device. Such arrangements can allow the room air purifier to be operated (and its operating status monitored) remotely, by way of signals sent back and forth between the external device and the control unit of the room air purifier, rather than being operated directly by way of controls located on the room air purifier itself. Such an external device may be any suitable device capable of receiving signals from a wireless communication unit and capable of transmitting signals and instructions to the wireless communication unit. In particular embodiments, the external device is a portable device such as a smartphone, a tablet computer, or a laptop computer.

Exemplary Embodiments and Combinations

A first exemplary embodiment is a powered room air purifier comprising an air inlet, an air outlet and an airflow path therethrough and comprising an interior space within which is located a non-movable air filter holder that is configured to receive a disposable air filter so that a filter medium of the disposable air filter is in the airflow path; wherein the non-movable air filter holder comprises upper, lower, left and right perimeter walls that collectively circumscribe a floor of the air filter holder, at least a major area of the floor being air-transmissive, wherein the room air purifier comprises at least one guide ramp located at an upper end of the air filter holder with a first, proximal end of the guide ramp being located proximate the upper perimeter wall of the air filter holder and being spaced apart from the floor of the air filter holder a first distance and with a second, distal end of the guide ramp being spaced apart from the floor of the air filter a second distance that is at least 20% greater than the first distance.

Embodiment two is the room air purifier of embodiment 1 wherein at least a distal portion of the at least one guide ramp is arcuately curved away from the floor of the air filter holder so as to exhibit a local radius of curvature that is smaller than 10.0 cm, at least at some location along the distal portion of the at least one guide ramp. Embodiment 3 is the room air purifier of any of embodiments 1-2 wherein a proximal portion of the at least one guide ramp exhibits a local radius of curvature that is greater than 40 cm, at least at some location within 1.5 cm of the upper perimeter wall of the air filter holder. Embodiment 4 is the room air purifier of any of embodiments 1-3 wherein the at least one guide ramp comprises a first, left guide ramp at an upper left corner of the air filter holder and a second, right guide ramp at an upper right corner of the air filter holder. Embodiment 5 is the room air purifier of any of embodiments 1-3 wherein the at least one guide ramp extends transversely across at least 70% of a transverse width of the air filter holder.

Embodiment 6 is the room air purifier of any of embodiments 1-5 wherein the room air purifier comprises a cover plate that is openable to expose an opening that allows access to the interior space of the room air purifier. Embodiment 7 is the room air purifier of embodiment 6 wherein the room air purifier comprises at least one movable filter-abutting structure configured so that when the cover plate of the room air purifier is closed with an air filter in place in the air filter holder, a forward abutting surface of the filter-abutting structure abuts at least a portion of the lower end of the air filter. Embodiment 8 is the room air purifier of embodiment 7 wherein the filter-abutting structure is configured so that when the cover plate of the room air purifier is closed, the forward abutting surface of the filter-abutting structure is in contact with at least a portion of the lower end of the air filter. Embodiment 9 is the room air purifier of any of embodiments 7-8 wherein the at least one movable filter-abutting structure is fixedly attached to a forward surface of the cover plate of the room air purifier. Embodiment 10 is the room air purifier of any of embodiments 7-9 wherein the at least one movable filter-abutting structure comprises a first filter-abutting structure that is configured so that a first forward abutting surface of the first filter-abutting structure abuts a lower left corner of an air filter that is in place in the air filter holder; and, a second filter-abutting structure that is configured so that a second forward abutting surface of the second filter-abutting structure abuts a lower right corner of the air filter; and wherein the first and second filter-abutting structures are each in the form of a member that protrudes forwardly from the forward surface of the cover plate.

Embodiment 11 is the room air purifier of any of embodiments 6-10 wherein with the room air purifier in an upright orientation with the cover plate fully open to fully expose the opening, the first, proximal end of the at least one guide ramp, at the upper end of the air filter holder, is not visible through the opening when viewed along a line of sight that is angled 15 or more degrees downward.

Embodiment 12 is the room air purifier of any of embodiments 1-11 further comprising an electric motor located within a housing of the room air purifier and a operatively connected to a fan, the fan being positioned in the airflow path and being configured to motivate air to pass through the air-transmissive major area of the floor of the air filter holder and through the filter medium of the disposable air filter. Embodiment 13 is the room air purifier of embodiment 12 wherein the fan is a centrifugal fan that is configured to receive air through an air inlet located in a lower portion of the room air purifier and to motivate the air upward so that the air impinges on the floor of the air filter holder and passes upwardly and forwardly through the air-transmissive major area of the floor of the air filter holder.

Embodiment 14 is the room air purifier of any of embodiments 1-13 further comprising a disposable air filter in place in the air filter holder of the room air purifier. Embodiment 15 is the room air purifier of embodiment 14 wherein the second distance is greater than a total thickness of the air filter by a factor of at least 20%; and, wherein the first distance is no more than 5% greater than the total thickness of the air filter. Embodiment 16 is the room air purifier of any of embodiments 14-15 wherein the floor of the air filter holder exhibits a major plane that is forwardly angled from 15 degrees to 50 degrees away from a vertical axis of the room air purifier so that the air filter, when in place in the air filter holder, is forwardly inclined from 15 degrees to 50 degrees relative to the vertical axis of the room air purifier. Embodiment 17 is the room air purifier of any of embodiments 14-16 wherein the disposable air filter comprises a framed particulate air filter and a prefilter.

Embodiment 18 is a process of installing a disposable air filter into a non-movable air filter holder in an interior space of a room air purifier, the process comprising manually grasping the air filter and performing a combination of: a) translationally moving the air filter inward through an opening in a housing of the room air purifier so that an upper end of the air filter moves forwardly and/or upwardly into the interior space of the room air purifier; and, b) rotating the air filter about a rotation axis that is aligned with a transverse direction of the air filter so that a lower end of the air filter moves forwardly and downwardly; wherein steps a) and b)

are performed any number of times, and in any order, sufficient to move the air filter into an air-filter-receiving space defined by the air filter holder.

Embodiment 19 is the process of embodiment 18 wherein the process comprises sequentially performing at least two steps a) and two steps b), in any order. Embodiment 20 is the process of any of embodiments 18-19 wherein at least at one time during the air-filter-installation process, a step a) and a step b) are performed simultaneously. Embodiment 21 is the process of any of embodiments 18-20 wherein a final step of the air-filter-installation process is a b) step in which the air filter is rotated about a rotation axis that is aligned with the transverse direction of the air filter and that passes through the upper end of the air filter, and which moves the lower end of the air filter forwardly and downwardly so that a lower peripheral sidewall of the lower end of the air filter abuts a lower perimeter wall of the air filter holder. Embodiment 22 is the process of embodiment 21 wherein a penultimate step of the air-filter-installation process is an a) translational motion step which results in an upper peripheral sidewall of the upper end of the air filter approaching an upper perimeter wall of the air filter holder and which also results in the lower peripheral sidewall of the lower end of the air filter being clear of the lower perimeter wall of the air filter holder so that the lower end of the air filter can be moved in the final, b) step of the installation process.

Embodiment 23 is the process of any of embodiments 18-22 wherein the performing of the air-filter-installation process causes the upper end of the air filter to follow a non-linear upward and forward path toward an upper end of the air filter holder. Embodiment 24 is the process of embodiment 23 wherein the non-linear upward and forward path followed by the upper end of the air filter comprises at least one upwardly-curved segment. Embodiment 25 is the process of any of embodiments 23-24 wherein the non-linear upward and forward path followed by the upper end of the air filter comprises at least one linear segment that is upwardly sloped and that is parallel to a floor of the air filter holder. Embodiment 26 is the process of embodiment 25 wherein, at least at some point during the air-filter-installation process, the upper end of the air filter is brought into contact with the floor of the air filter holder; and, as the air filter is then translationally moved in a step a), the upper end of the air filter slides upward and forward along the floor of the air filter holder.

Embodiment 27 is the process of any of embodiments 18-26 wherein at least one step a) of the air-filter-installation process is performed by manually grasping the lower end of the air filter and applying a motivating force to the lower end of the air filter in an at least generally forward and/or upward direction; and, wherein at least at some point during this step a), the upper end of the air filter moves forward and upward along a path that is upwardly offset from 20 degrees to 70 degrees relative to a direction along which the motivating force is applied to the lower end of the air filter.

Embodiment 28 is the process of any of embodiments 18-27 wherein at least one translational motion step a) is performed in which at least at some point during this step a), the upper end of the air filter moves forward and upward along a path that is upwardly offset from 20 degrees to 70 degrees relative to a major plane of the air filter.

Embodiment 29 is the process of any of embodiments 18-28 wherein after the steps a) and b) are completed so that the air filter is positioned in the air-filter-receiving space defined by the air filter holder, a cover plate of the room air purifier is closed thus closing the opening in the housing of the room air purifier. Embodiment 30 is the process of any of embodiments 18-29 wherein prior to performing a step a) or a step b), a cover plate of the room air purifier is opened thus exposing the opening in the housing of the room air purifier through which the air filter can be inserted.

Embodiment 31 is the process of any of embodiments 18-20 wherein the process is performed without an upper end of the air filter holder being visible through the opening in the housing of the room air purifier to a person that is performing the process.

Embodiment 32 is the process of any of embodiments 18-31, used to install a disposable air filter into a powered room air purifier of any of embodiments 1-14.

Embodiment 33 is a process of removing a disposable air filter from a non-movable air filter holder in an interior space of a room air purifier, the process comprising manually grasping the air filter and: performing an initial step 1) of rotating the air filter about a rotation axis that is proximate an upper end of the air filter and that is aligned with a transverse direction of the air filter, so that a lower end of the air filter moves upwardly and rearwardly within the interior space of the room air purifier; then, performing a combination of: 2) translationally moving the air filter so that the upper end of the air filter moves rearwardly and/or downwardly within the interior space of the room air purifier; and, 3) rotating the air filter about a rotation axis that is aligned with a transverse direction of the air filter so that a lower end of the air filter moves rearwardly and upwardly; wherein steps 2) and 3) are performed any number of times, and in any order, sufficient to move the air filter out of an air-filter-receiving space defined by the air filter holder and out of the interior space of the room air purifier. Embodiment 34 is the process of embodiment 33, used to remove a disposable air filter from a powered room air purifier of any of embodiments 1-17. Embodiment 34a is the process of any of embodiments 18-32 wherein the disposable air filter comprises a particulate air filter and a prefilter.

Embodiment 35 is a powered room air purifier comprising an air inlet, an air outlet and an airflow path therethrough and comprising an interior space within which is located a non-movable air filter holder that is configured to receive a disposable air filter so that a filter medium of the disposable air filter is in the airflow path; wherein the non-movable air filter holder comprises upper, lower, left and right perimeter walls that collectively circumscribe a floor of the air filter holder, at least a major area of the floor being air-transmissive, and wherein the floor of the air filter holder exhibits a major plane that is angled from 15 degrees to 50 degrees away from a vertical axis of the room air purifier so that a disposable air filter, when in place in the air filter holder, is inclined from 15 degrees to 50 degrees relative to the vertical axis of the room air purifier. Embodiment 36 is the powered room air purifier of embodiment 35 wherein the floor of the air filter holder, and the upper, lower, and left and right perimeter walls of the air filter holder, are not portions of a single, unitary air filter holder but rather are all provided by portions of separate components of the powered room air purifier, which portions combine to collectively provide the air filter holder. Embodiment 37 is the powered room air purifier of any of embodiments 35-36 wherein the powered room air purifier comprises a centrifugal fan located near the bottom of the powered room air purifier and configured to receive unfiltered air and motivate the air toward a disposable air filter installed in the non-movable air filter holder. Embodiment 38 is the powered room air purifier of any of embodiments 35-37 further comprising any of the features described in any of embodiments 1-17.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document that is incorporated by reference herein, this specification as written will control.

What is claimed is:

1. A process of installing a disposable air filter into a non-movable air filter holder in an interior space of a room air purifier, the powered room air purifier comprising an air inlet, an air outlet and an airflow path therethrough and comprising an interior space within which is located the non-movable air filter holder that is configured to receive the disposable air filter so that a filter medium of the disposable air filter is in the airflow path;

wherein the non-movable air filter holder comprises upper, lower, left and right perimeter walls that collectively circumscribe a floor of the non-movable air filter holder, at least a major area of the floor being air-transmissive, wherein the room air purifier comprises at least one guide ramp located at an upper end of the non-movable air filter holder with a first, proximal end of the at least one guide ramp being located proximate the upper perimeter wall of the non-movable air filter holder and being spaced apart from the floor of the non-movable air filter holder a first distance and with a second, distal end of the at least one guide ramp being spaced apart from the floor of the non-movable air filter holder a second distance that is at least 20% greater than the first distance;

and wherein the process of installing the disposable air filter into the non-movable air filter holder in the interior space of the room air purifier comprises manually grasping the disposable air filter and performing a combination of:

a) translationally moving the disposable air filter inward through an opening in a housing of the room air purifier so that an upper end of the disposable air filter moves forwardly and/or upwardly into the interior space of the room air purifier; and, b) rotating the disposable air filter about a rotation axis that is aligned with a transverse direction of the disposable air filter so that a lower end of the air filter moves forwardly and downwardly;

wherein steps a) and b) are performed any number of times, and in any order, sufficient to move the disposable air filter into an air-filter-receiving space defined by the non-movable air filter holder;

and, wherein at least one translational motion step a) is performed in which at least at some point during this step a), the upper end of the disposable air filter moves forward and upward along a path that is upwardly offset from 20 degrees to 70 degrees relative to a major plane of the disposable air filter.

2. The process of claim 1 wherein at least a distal portion of the at least one guide ramp is arcuately curved away from the floor of the non-movable air filter holder so as to exhibit a local radius of curvature that is smaller than 10.0 cm, at least at some location along the distal portion of the at least one guide ramp.

3. The process of claim 2 wherein a proximal portion of the at least one guide ramp exhibits a local radius of curvature that is greater than 40 cm, at least at some location within 1.5 cm of the upper perimeter wall of the non-movable air filter holder.

4. The process of claim 1 wherein the at least one guide ramp comprises a first, left guide ramp at an upper left corner of the air filter holder and a second, right guide ramp at an upper right corner of the non-movable air filter holder.

5. The process of claim 1 wherein the room air purifier comprises a cover plate that is openable to expose an opening that allows access to the interior space of the room air purifier.

6. The process of claim 5 wherein the room air purifier comprises at least one movable filter-abutting structure configured so that when the cover plate of the room air purifier is closed with the disposable air filter in place in the non-movable air filter holder, a forward abutting surface of the at least one movable filter-abutting structure abuts at least a portion of the lower end of the disposable air filter.

7. The process of claim 6 wherein the at least one movable filter-abutting structure is configured so that when the cover plate of the room air purifier is closed, the forward abutting surface of the at least one movable filter-abutting structure is in contact with at least a portion of the lower end of the disposable air filter.

8. The process of claim 6 wherein the at least one movable filter-abutting structure is fixedly attached to a forward surface of the cover plate of the room air purifier.

9. The process of claim 6 wherein the at least one movable filter-abutting structure comprises a first movable filter-abutting structure that is configured so that a first forward abutting surface of the first movable filter-abutting structure abuts a lower left corner of the disposable air filter that is in place in the non-movable air filter holder; and, a second movable filter-abutting structure that is configured so that a second forward abutting surface of the second movable filter-abutting structure abuts a lower right corner of the disposable air filter; and wherein the first and second movable filter-abutting structures are each in the form of a member that protrudes forwardly from the forward surface of the cover plate.

10. The process of claim 5 wherein with the room air purifier in an upright orientation with the cover plate fully open to fully expose the opening, the first, proximal end of the at least one guide ramp, at the upper end of the non-movable air filter holder, is not visible through the opening when viewed along a line of sight that is angled 15 or more degrees downward.

11. The process of claim 1 wherein the second distance is greater than a total thickness of the disposable air filter by a factor of at least 20%; and, wherein the first distance is no more than 5% greater than the total thickness of the disposable air filter.

12. The process of claim 1 wherein the floor of the non-movable air filter holder exhibits a major plane that is forwardly angled from 15 degrees to 50 degrees away from a vertical axis of the room air purifier so that the disposable air filter, when in place in the non-movable air filter holder, is forwardly inclined from 15 degrees to 50 degrees relative to the vertical axis of the room air purifier.

13. The process of claim 1 wherein the process comprises sequentially performing at least two steps a) and two steps b), in any order.

14. The process of claim 1 wherein at least at one time during the disposable-air-filter-installation process, a step a) and a step b) are performed simultaneously.

15. The process of claim 1 wherein a final step of the disposable-air-filter-installation process is a b) step in which the disposable air filter is rotated about a rotation axis that is aligned with the transverse direction of the disposable air filter and that passes through the upper end of the air filter, and which moves the lower end of the disposable air filter forwardly and downwardly so that a lower peripheral sidewall of the lower end of the disposable air filter abuts a lower perimeter wall of the non-movable air filter holder.

16. The process of claim 15 wherein a penultimate step of the disposable-air-filter-installation process is an a) translational motion step which results in an upper peripheral sidewall of the upper end of the disposable air filter approaching an upper perimeter wall of the non-movable air filter holder and which also results in the lower peripheral sidewall of the lower end of the disposable air filter being clear of the lower perimeter wall of the non-movable air filter holder so that the lower end of the disposable air filter can be moved in the final, b) step of the installation process.

17. The process of claim 1 wherein the performing of the disposable-air-filter-installation process causes the upper end of the disposable air filter to follow a non-linear upward and forward path toward an upper end of the air filter holder.

18. The process of claim 17 wherein the non-linear upward and forward path followed by the upper end of the disposable air filter comprises at least one upwardly-curved segment.

19. The process of claim 1 wherein, at least at some point during the disposable-air-filter-installation process, the upper end of the disposable air filter is brought into contact with the floor of the non-movable air filter holder; and, as the disposable air filter is then translationally moved in a step a), the upper end of the disposable air filter slides upward and forward along the floor of the non-movable air filter holder.

20. The process of claim 19 wherein at least one step a) of the disposable-air-filter-installation process is performed by manually grasping the lower end of the disposable air filter and applying a motivating force to the lower end of the disposable air filter in an at least generally forward and/or upward direction; and, wherein at least at some point during this step a), the upper end of the disposable air filter moves forward and upward along a path that is upwardly offset from 20 degrees to 70 degrees relative to a direction along which the motivating force is applied to the lower end of the disposable air filter.

21. A process of installing a disposable air filter into a non-movable air filter holder in an interior space of a room air purifier, the room air purifier comprising an air inlet, an air outlet and an airflow path therethrough and comprising the interior space within which is located the non-movable air filter holder that is configured to receive the disposable air filter so that a filter medium of the disposable air filter is in the airflow path;

wherein the non-movable air filter holder comprises upper, lower, left and right perimeter walls that collectively circumscribe a floor of the non-movable air filter holder, at least a major area of the floor being air-transmissive, wherein the room air purifier comprises at least one guide ramp located at an upper end of the non-movable air filter holder with a first, proximal end of the at least one guide ramp being located proximate the upper perimeter wall of the non-movable air filter holder and being spaced apart from the floor of the non-movable air filter holder a first distance and with a second, distal end of the at least one guide ramp being spaced apart from the floor of the non-movable air filter holder a second distance that is at least 20% greater than the first distance;

and wherein the process of installing the disposable air filter into the non-movable air filter holder in the interior space of the room air purifier comprises manually grasping the disposable air filter and performing a combination of:

a) translationally moving the disposable air filter inward through an opening in a housing of the room air purifier so that an upper end of the disposable air filter moves forwardly and/or upwardly into the interior space of the room air purifier; and, b) rotating the disposable air filter about a rotation axis that is aligned with a transverse direction of the disposable air filter so that a lower end of the air filter moves forwardly and downwardly;

wherein steps a) and b) are performed any number of times, and in any order, sufficient to move the disposable air filter into an air-filter-receiving space defined by the non-movable air filter holder;

and, wherein the process is performed without an upper end of the non-movable air filter holder being visible through the opening in the housing of the room air purifier to a person that is performing the process.

22. A process of installing a disposable air filter into a non-movable air filter holder in an interior space of a room air purifier, the room air purifier comprising an air inlet, an air outlet and an airflow path therethrough and comprising the interior space within which is located the non-movable air filter holder that is configured to receive the disposable air filter so that a filter medium of the disposable air filter is in the airflow path;

wherein the non-movable air filter holder comprises upper, lower, left and right perimeter walls that collectively circumscribe a floor of the non-movable air filter holder, at least a major area of the floor being air-transmissive, wherein the room air purifier comprises at least one guide ramp located at an upper end of the non-movable air filter holder with a first, proximal end of the at least one guide ramp being located proximate the upper perimeter wall of the non-movable air filter holder and being spaced apart from the floor of the non-movable air filter holder a first distance and with a second, distal end of the at least one guide ramp being spaced apart from the floor of the non-movable air filter holder a second distance that is at least 20% greater than the first distance;

and wherein the process of installing the disposable air filter into the non-movable air filter holder in the interior space of the room air purifier comprises manually grasping the disposable air filter and performing a combination of:

a) translationally moving the disposable air filter inward through an opening in a housing of the room air purifier so that an upper end of the disposable air filter moves forwardly and/or upwardly into the interior space of the room air purifier; and, b) rotating the disposable air filter about a rotation axis that is aligned with a transverse direction of the disposable air filter so that a lower end of the air filter moves forwardly and downwardly;

wherein steps a) and b) are performed any number of times, and in any order, sufficient to move the disposable air filter into an air-filter-receiving space defined by the non-movable air filter holder;

wherein the performing of the disposable-air-filter-installation process causes the upper end of the disposable air filter to follow a non-linear upward and forward path toward an upper end of the air filter holder; and wherein the non-linear upward and forward path followed by the upper end of the disposable air filter comprises at least one linear segment that is upwardly sloped and that is parallel to a floor of the non-movable air filter holder.

* * * * *